US007155341B2

(12) United States Patent
Kimura et al.

(10) Patent No.: US 7,155,341 B2
(45) Date of Patent: Dec. 26, 2006

(54) SYSTEM AND METHOD FOR INFORMING VEHICLE ENVIRONMENT

(75) Inventors: Takeshi Kimura, Yokohama (JP); Tatsuya Suzuki, Kanagawa (JP); Genpei Naito, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/449,233

(22) Filed: Jun. 2, 2003

(65) Prior Publication Data

US 2003/0236624 A1 Dec. 25, 2003

(30) Foreign Application Priority Data

Jun. 21, 2002 (JP) ..... 2002-181150

(51) Int. Cl.
*G08G 1/16* (2006.01)

(52) U.S. Cl. ..... 701/301; 701/70

(58) Field of Classification Search ..... 701/301, 701/70, 96; 180/167, 169; 342/70, 71
See application file for complete search history.

(56) References Cited

U.S. PATENT DOCUMENTS

| | | | | |
|---|---|---|---|---|
| 5,113,721 | A * | 5/1992 | Polly | 477/80 |
| 6,147,600 | A * | 11/2000 | Faye | 340/467 |
| 6,223,118 | B1 * | 4/2001 | Kobayashi et al. | 701/96 |
| 6,282,483 | B1 | 8/2001 | Yano et al. | |
| 6,379,281 | B1 * | 4/2002 | Collins et al. | 477/107 |
| 6,411,882 | B1 * | 6/2002 | Bidner et al. | 701/93 |
| 6,434,472 | B1 * | 8/2002 | Minowa et al. | 701/96 |
| 6,622,074 | B1 * | 9/2003 | Coelingh et al. | 701/48 |
| 6,739,135 | B1 * | 5/2004 | Criddle et al. | 60/608 |
| 2004/0183661 | A1 * | 9/2004 | Bowman | 340/435 |

FOREIGN PATENT DOCUMENTS

| | | | |
|---|---|---|---|
| JP | 1-95946 | A | 4/1989 |
| JP | 9-286313 | A | 11/1997 |
| JP | 2000-52809 | A | 2/2000 |
| JP | 2001-191815 | A | 7/2001 |

OTHER PUBLICATIONS

U.S. Appl. No. 60/434,881.*
B. Schiller et al., "Collision Avoidance for Highway Vehicles Using the Virtual Bumper Control", IEEE International Conference on Intelligent Vehicles, 1998, pp. 149-155.

* cited by examiner

*Primary Examiner*—Michael J. Zanelli
(74) *Attorney, Agent, or Firm*—Foley & Lardner LLP

(57) ABSTRACT

An information system for a host vehicle is comprised of an accelerator manipulation detecting device that detects an accelerator manipulation quantity of an accelerator according to which a driver demand driving force is generated by an internal combustion engine, an object detecting unit that detects an object ahead of the host vehicle; and a controller which is connected to the accelerator manipulation detecting device and the object detecting unit. The controller determines a contact possibility that the host vehicle will contact with an object ahead of the host vehicle, on the basis of information from the objecting detecting unit, and corrects a driving-force relationship between the driver demand driving force and the accelerator manipulation quantity according to the contact possibility. The controller may include a processor that employs a simulation of a virtual member in front of the host vehicle which provides feedback to a driver of the host vehicle based on a relationship between the host vehicle and an object ahead of the host vehicle. The virtual member may be, for example, a virtual spring.

39 Claims, 17 Drawing Sheets

IN CASE OF LONG INTER-VEHICLE DISTANCE

IN CASE OF SHORT INTER-VEHICLE DISTANCE

SYSTEM AND METHOD FOR INFORMING VEHICLE ENVIRONMENT

BACKGROUND OF THE INVENTION

The present invention relates to a system and method which provides information as to an environment of a host vehicle according to a possibility of contacting with an object ahead of the host vehicle by executing a vehicle deceleration control according to the environment.

Japanese Patent Provisional Publication No. 9-286313 discloses an alarming system which comprises an obstacle detecting means for detecting an obstacle ahead of a host vehicle and an alarming means for giving a driver an alarm by lowering a vehicle speed when it is determined that a host vehicle will contact with an obstacle ahead of the host vehicle, on the basis of information of the obstacle detecting means.

SUMMARY OF THE INVENTION

However, this alarming system is arranged to limit the acceleration of the host vehicle by a driver's intervention when the alarming operation of lowering the vehicle speed is being executed, and therefore there is a possibility that this alarming system prevents a driver from intentionally controlling the host vehicle during the operation of the alarming system.

It is therefore an object of the present invention to provide an improved information system and method, which allows the driver's intervention even when the information system is generating the alarm information by lowering vehicle speed.

An aspect of the present invention resides in providing a controller for a host vehicle which has an object detecting unit that detects an object ahead of the host vehicle. The controller comprises a simulation of a virtual member in front of the host vehicle which provides feedback to a driver of the host vehicle based on a relationship between the host vehicle and an object ahead of the host vehicle. The virtual member may be, for example, a virtual spring.

An aspect of the present invention resides in an information system for a host vehicle which comprises an accelerator manipulation detecting device that detects an accelerator manipulation quantity of an accelerator according to which a driver demand driving force is generated by an internal combustion engine; an object detecting unit that detects an object ahead of the host vehicle; and a controller connected to the accelerator manipulation detecting device and the object detecting unit. The controller is configured to determine a contact possibility that the host vehicle will contact with an object ahead of the host vehicle, on the basis of information from the objecting detecting unit, and to correct a driving-force relationship between the driver demand driving force and the accelerator manipulation quantity according to the contact possibility.

Another aspect of the present invention resides in a method of informing a contact possibility of a host vehicle with an object ahead of the host vehicle. The method comprises an operation of determining a contact possibility that the host vehicle will contact with an object ahead of the host vehicle and an operation of correcting a driving-force relationship between a driver demand driving force and an accelerator manipulation quantity according to the contact possibility.

A further aspect of the present invention resides in a method of informing a contact possibility of a host vehicle with an object ahead of the host vehicle. The method comprises an operation of detecting an environment of the host vehicle and an operation of correcting a driving-force relationship between a driver demand driving force and an accelerator manipulation quantity according to the detected environment.

Other objects and features of this invention will become understood from the following description with reference to the accompanying drawings.

DETAILED DESCRIPTION OF THE INVENTION

Referring to FIGS. 1 through 15, there is shown a first embodiment of an information system provided in a cruise control system in accordance with the present invention.

Figure 1:
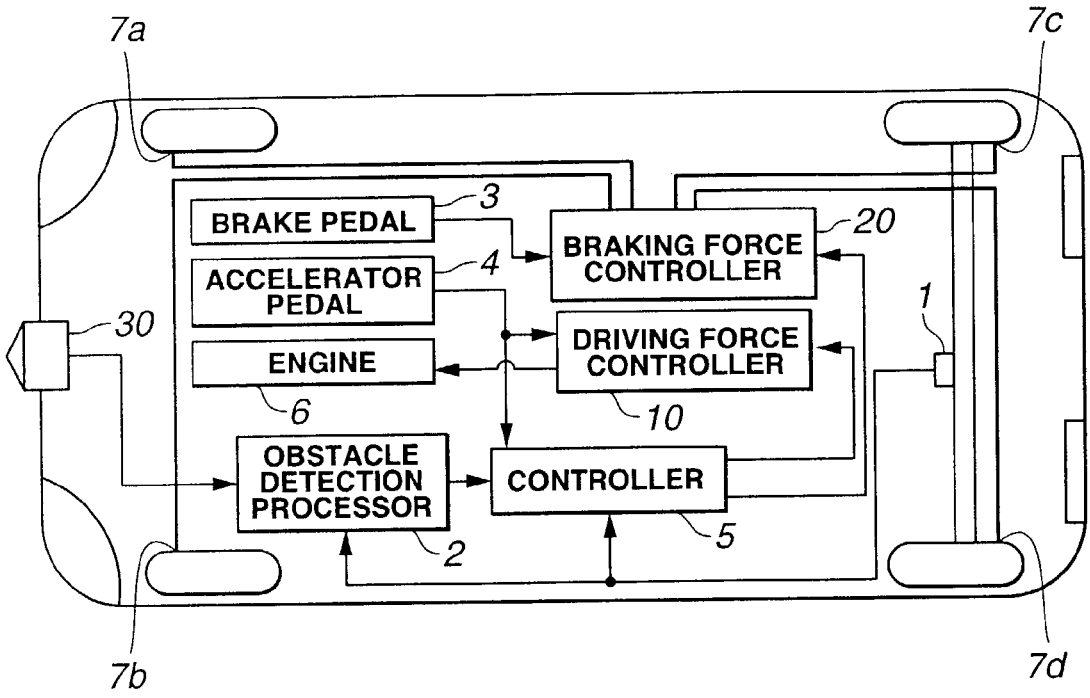
FIG. 1 is a schematic view showing a construction of a cruise control system with an information system according to a first embodiment of the present invention.

As shown in FIG. 1, this cruise control system comprises a radar device 30, a vehicle speed sensor 1, an obstacle detection processor 2, a brake pedal 3, an accelerator pedal 4, a braking force controller 20, a driving force controller 10, a controller 5 and an internal combustion engine 6. Further, the cruise control system comprises a steering angle sensor and the like though not particularly shown in Figures.

Driving force controller 10 controls engine 6 so that a driving force (driving torque) is in accordance with a manipulated state of accelerator pedal 4 acting as accelerator manipulating means. Further, driving force controller 10 is arranged to vary the driving force according to a command from an external command.

Figure 2:
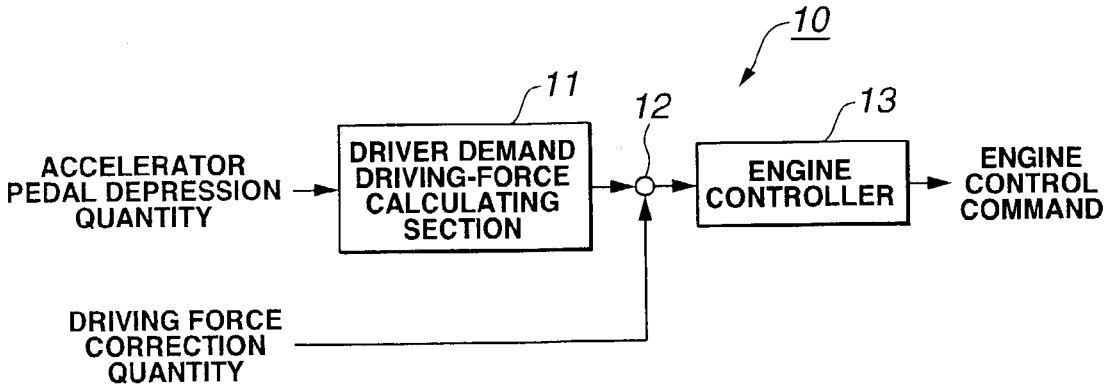
FIG. 2 is a block diagram showing a driving force controller of the cruise control system shown in FIG. 1.
Figure 3:
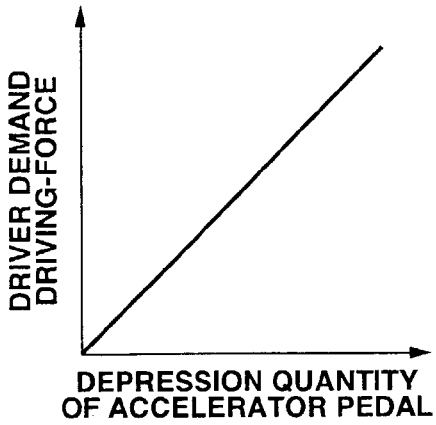
FIG. 3 is a graph showing a characteristic map representative of a relationship between an accelerator-pedal depression quantity and a driver-demand driving force.

FIG. 2 shows driving force controller 10 in the form of a block diagram. Driving force controller 10 comprises a driver-demand driving-force calculating section 11, an adder 12 and an engine controller 13.

Driver-demand driving-force calculating section 11 calculates a driving force demanded by a driver according to a depression quantity of accelerator pedal 4. The depression quantity corresponds to the manipulated quantity of the accelerator pedal. Hereinafter, this driving force demanded by the driver is called a driver-demand driving force Fd. For example, driver-demand driving-force calculating section 11 retrieves the driver-demand driving force Fd from a driver-demand driving-force map showing a relationship between the accelerator depression quantity and the driver-demand driving force shown in FIG. 3. Driver-demand driving-force calculating section 11 outputs the obtained driver demand driving force to engine controller 13 through adder 12. The driver-demand driving-force map is stored in driver-demand driving-force calculating section 11.

Engine controller 13 calculates a control command indicative of a target driving force for generating the driver-demand driving force at engine 6. Therefore, engine 6 is driven on the basis of this control command. Adder 12 of driving force controller 10 receives a driving-force correction quantity. When the driving-force correction quantity is inputted to adder 12, engine controller 13 receives the final target driving force, which is the sum of the initial target driving force and the driving force correction quantity.

Thus, the driver-demand driving force is calculated according to the accelerator-pedal depression quantity at driver-demand driving-force calculating section 11 of driving force controller 10. On the other hand, when the driving force correction quantity is inputted to driving force controller 10, the final target driving force is obtained at adder 12 by adding this driving force correction quantity and the initial target driving force, and engine controller 13 calculates the control command to be inputted to engine 6 according to the final target driving force.

Braking force controller 20 controls brake hydraulic pressure applied to each brake 7*a*, 7*b*, 7*c*, 7*d* of each wheel so that brakes 7*a* through 7*d* generate a braking force according to the manipulated state of brake pedal 3 acting as brake manipulating means. Further, braking force controller 20 varies the braking force according to an external command.

Figure 4:
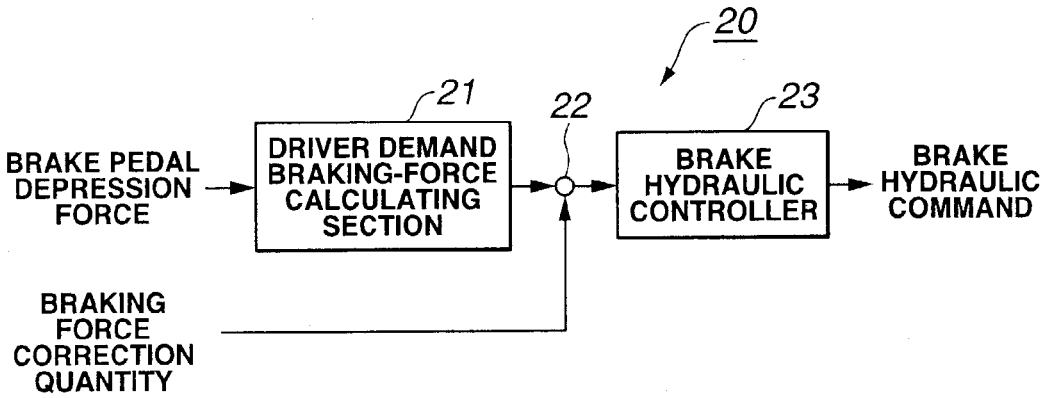
FIG. 4 is a block diagram showing a braking force controller of the cruise control system shown in FIG. 1.

FIG. 4 shows braking force controller 20 in the form of a block diagram. Braking force controller 20 comprises a driver-demand braking force calculating section 21, an adder 21 and a brake hydraulic pressure controller 23.

Figure 5:
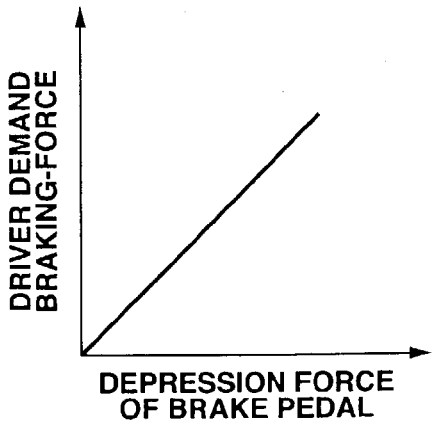
FIG. 5 is a graph showing a characteristic map representative of a relationship between a brake-pedal depression force and a driver-demand braking force.

Driver-demand braking-force calculating section 21 calculates a driver-demand braking-force, which is a braking force demanded by a driver, according to a depression force to brake pedal 3. Hereinafter, this depression force to brake pedal 3 is called a brake pedal depression force. In this embodiment, driver-demand braking-force calculating section 21 retrieves the driver-demand braking force corresponding to the brake pedal depression from a characteristic map which represents a relationship between the brake pedal depression force and the driver-demand braking force as shown in FIG. 5 and which is called a driver-demand braking force map. Driver-demand braking-force calculating section 21 outputs the driver-demand braking force to brake hydraulic pressure controller 23 through adder 22. Driver-demand braking-force calculating section 21 has previously stored the driver-demand braking force map.

Brake hydraulic pressure controller 23 calculates the brake hydraulic pressure command using the driver-demand braking force as a target braking force. Adder 22 of braking force controller 20 receives a braking force correction quantity. When adder 22 receives the braking force correction quantity, brake hydraulic pressure controller 23 receives a final target braking force which is the sum of the initial target braking force and the braking force correction quantity as a target braking force.

Thus, braking force controller 20 calculates the driver-demand braking force at driver-demand braking-force calculating section 21 according to the brake pedal depression force. On the other hand, when the braking force correction quantity is inputted, braking force controller 20 obtains the final target braking force at adder 22 by adding the braking force correction quantity to the driver-demand braking-force calculated at driver-demand braking-force calculating section 21. Further, brake force controller 20 calculates the brake hydraulic pressure command according to the final target braking force at brake hydraulic pressure controller 23.

Radar device 30 is disposed at a front portion of the host vehicle as shown in FIG. 1 and obtains a distance between the host vehicle and an object ahead of the host vehicle through the operations of detecting the object and calculating the distance.

Figure 6:
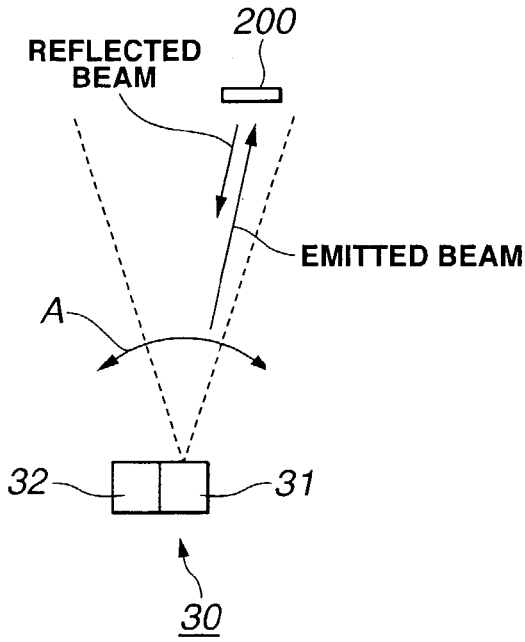
FIG. 6 is a schematic view showing a radar device of the cruise control system.

As shown in FIG. 6, radar device 30 comprises a beam emitting section 31 for emitting an infrared laser beam and a beam receiving section 32 for receiving the reflected beam of the beam emitted from beam emitting section 31 and for outputting a voltage corresponding to the received beam. Beam emitting section 31 and beam receiving section 32 are adjacently disposed as shown in FIG. 6. Beam emitting section 31 is combined with a scanning mechanism and scans the beam as shown by the arrow A of FIG. 6. Accordingly, beam emitting section 31 sequentially emits the infrared laser beam while changing the direction of the emitted beam within a predetermined angular area. Radar device 30 measures a distance between the host vehicle 300 and the object 200 ahead of the host vehicle 300 on the basis of the time period between the beam emitting moment of emitting the laser beam at beam emitting section 31 and the beam receiving moment of receiving the reflected beam at beam receiving section 32.

Radar device 30 scans the laser beam in the right and left directions by swinging beam emitting section 31 in the right and left direction using the scanning mechanism. That is, radar device 30 determines whether the reflected beam is received at each scanning position or scanning angle. In case that the reflected beam is received, radar device 30 calculates a distance between host vehicle 300 and object 200. Further, radar device 30 calculates a direction of the detected object 200 with respect to host vehicle 300 on the basis of the scanning angle and the distance to object 200 at the moment when object 200 is detected. Consequently, radar device 30 specifies the relative position of the object 200 ahead of the host vehicle with respect to the host vehicle 300.

Figure 7:
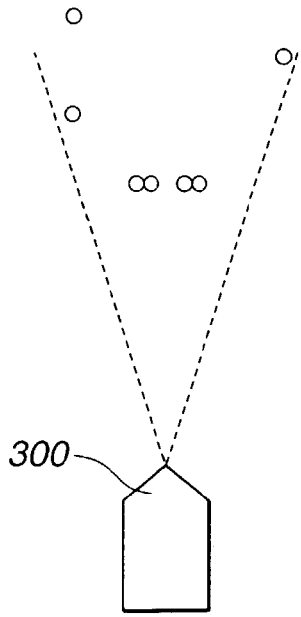
FIG. 7 is a schematic view showing the detection result of obstacles detected by scanning operation of the radar device.

FIG. 7 shows an example of a detection result of objects obtained by the scanning operation of radar device 30. By specifying the relative position of objects with respect to the host vehicle at each scanning angle, it becomes possible to detect a plurality of objects within the scanning zone as a 2-dimensional object existing state as shown in FIG. 7.

Beam emitting section 31 of radar device 30 may not be limited to an optical type which emits an infrared beam, and may be a radio-wave type for emitting microwaves or millimeter-waves. Further, radar device 30 may be constructed so as to detect objects 200 ahead of the host vehicle 300 by processing video images showing a view ahead of the host vehicle. Radar device 30 outputs the detection data indicative of the positional information of the object 200 ahead of the host vehicle to obstacle detection processor 2.

Obstacle detection processor 2 is arranged to obtain the information of the obstacle 200 ahead of the host vehicle on the basis of the detection result of radar device 30. More specifically, obstacle detection processor 2 determines the motion of the detected objects by comparing the existing states of the detected objects at scanning intervals. Further, obstacle detection processor 2 determines whether or not the detected objects are the same one, on the basis of the information indicative of an approaching state among the obstacles and the similarity of motions of the obstacles.

By this processing, obstacle detection processor 2 obtains a longitudinal distance X (m) between the host vehicle and the object ahead of the host vehicle, a lateral distance Y (m) of the object with respect to the host vehicle, a width W (m) of the object and a relative speed ΔV (m/s) between a traveling speed of the host vehicle and a traveling speed of the object. When there are detected a plurality of objects, obstacle detection processor 2 obtains the information as to each of the detected objects. Obstacle detection processor 2 outputs the information to controller 5 at predetermined time intervals.

Controller 5 is arranged to execute various controls for the host vehicle. The controls relating to the present invention will be discussed hereinafter. Controller 5 receives the vehicle speed information from vehicle speed sensor 1, the obstacle detection result from obstacle detection processor 2, the manipulation state information from accelerator pedal 4 and the like. Controller 5 calculates the command signal on the basis of the received information and outputs the command signal to driving force controller 10 and braking force controller 20.

Figure 8:
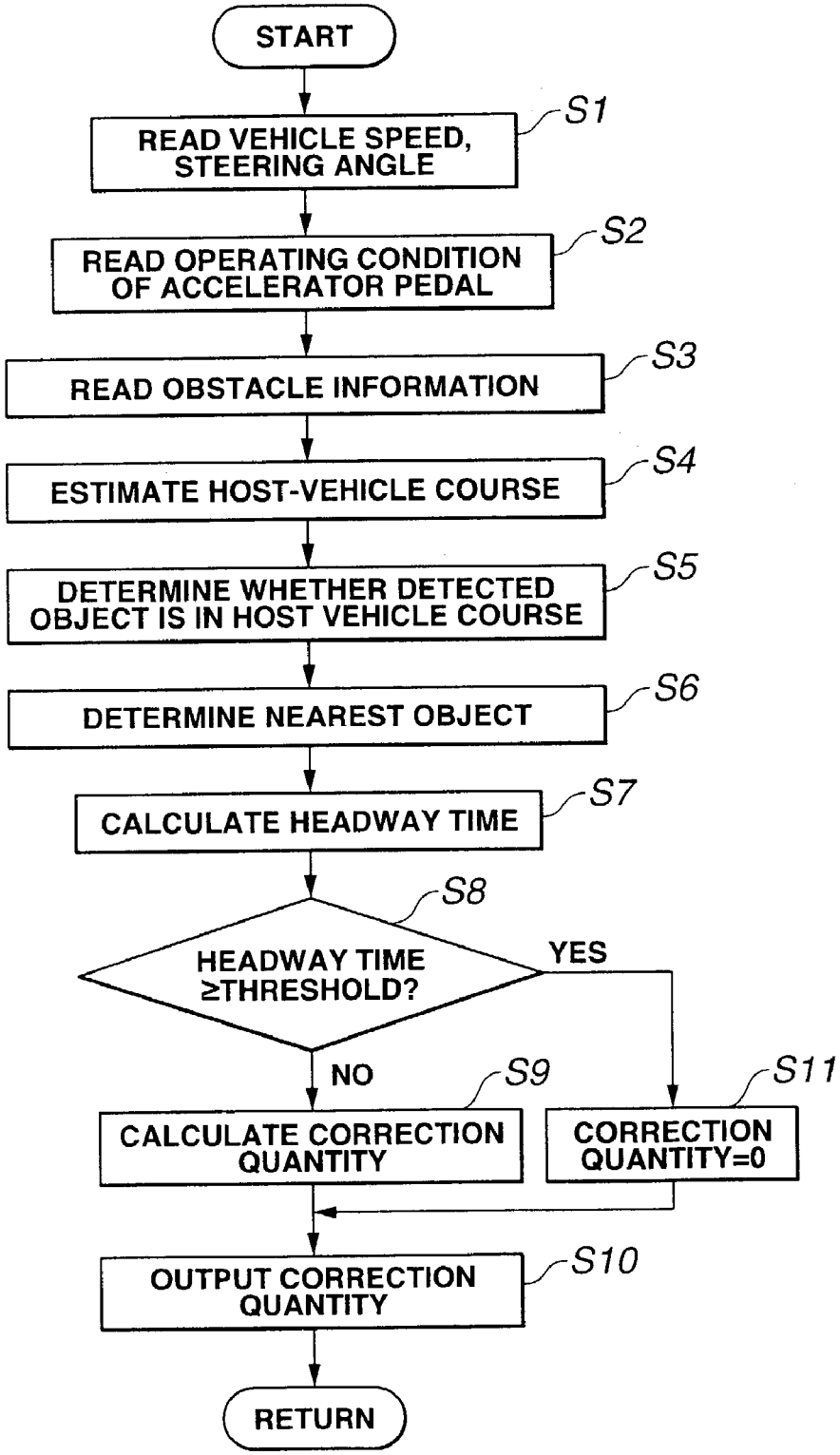
FIG. 8 is a flowchart showing a procedure for the calculation of a correction quantity by a controller of the cruise control system.

The procedure on the control executed by controller 5 will be discussed with reference to FIG. 8. This control processing shown in FIG. 8 is a timer interruption subroutine executed at predetermined time intervals.

At step S1 controller 5 reads vehicle speed data from vehicle speed sensor 1 and steering angle data from the steering angle sensor. Both vehicle speed sensor 1 and the steering angle sensor are encoders outputting pulses according to the revolution speed or the steered angle. Controller 5 calculates a steering angle δ (rad) and host vehicle speed V (m/s) by counting the number of the outputted pulses from the steering angle sensor and vehicle speed sensor 1, respectively. The calculation results are stored in a memory of controller 5.

At step S2 controller 5 reads the information indicative of the manipulation state of accelerator pedal 4. The information as to the manipulation state of accelerator pedal 4 includes the accelerator pedal depression quantity corresponding to a stroke displacement of accelerator pedal 4.

At step S3 controller 5 reads longitudinal distance X (m), lateral distance Y (m), width W (m) and relative speed ΔV (m/s). For example, controller 5 communicates with obstacle detection processor 2 to execute information interchange by means of a serial communication, and stores the information from obstacle detection processor 2 in the memory thereof.

At step S4 controller 5 estimates a near-future host-vehicle course on the basis of host vehicle speed V and steering angle δ as follows.

A turn curvature ρ (1/m) of the host vehicle according to vehicle speed V and steering angle δ is commonly expressed by the following expression (1).

$$\rho=\{1/(1+A\cdot V^2)\cdot L\}\cdot(\delta/N) \quad (1)$$

where L is a wheel base of the host vehicle, A is a stability factor which is determined according to the vehicle and takes a positive constant, and N is a steering gear ratio.

Further, a turn radius R of the host vehicle is expressed by the following expression (2) using turn curvature ρ.

$$R=1/\rho \quad (2)$$

Figure 9:
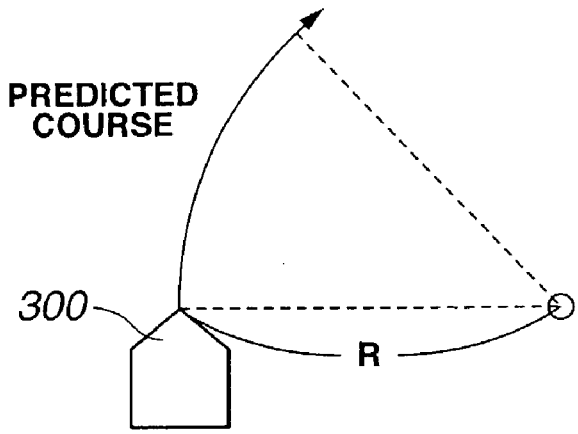
FIG. 9 is a view employed to explain a predicted host-vehicle course predicted by the cruise control system.

By employing turn radius R, the predicted course of the host vehicle is obtained as an arc of a radius R around a center at a point which is apart from the host vehicle by a distance R in the direction perpendicular to the direction of the host vehicle as shown in FIG. 9. In FIG. 9, the center point of the turn radius R is located in the right hand side apart from the host vehicle by the distance R.

In the following explanation, steering angle δ takes a positive value when the host vehicle is steered in the right hand side direction, and takes a negative value when the host vehicle is steered in the left hand side direction. Further, when steering angle δ takes a positive value, the turn curvature and the turn radius represent the right turn. When they take a negative value, they represent the left turn.

Figure 10:
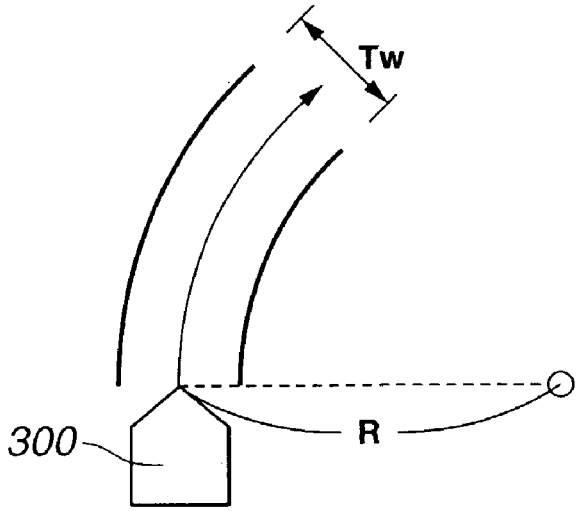
FIG. 10 is a view employed to explain a predicted route determined taking account of a vehicle width.

Further, the predicted course of the host vehicle is converted into a course taking account of the vehicle width or a lane width. More specifically, the aforementioned predicted course merely shows a locus which predicts a proceeding direction of the host vehicle. Therefore, it is necessary to determine an area (zone), on which the host vehicle travels, taking account of the vehicle width or lane width. FIG. 10 shows a predicted course obtained by taking account of the vehicle width Tw. This predicted course is defined by an arc of a radius T−Tw/2 on the center the same as that of the predicted course and an arc of a radius T+Tw/2 on the center.

Using a yaw rate γ instead of steering angle δ, the predicted course may be expressed by the following expression (3) as the relationship between yaw rate γ and host vehicle speed V.

$$R=V/\gamma \quad (3)$$

Further, the predicted course may be expressed by the following expression (4) as the relationship between the lateral acceleration Yg and the host vehicle speed V.

$$R=V^2/Yg \quad (4)$$

Hereinafter, the explanation of the control executed by controller 5 is explained on the assumption that the predicted course is obtained on the basis of the relationship between host vehicle speed V and steering angle δ.

At step S5 subsequent to the execution of step S4, controller 5 determines whether or not the detected objects are located on the predicted course.

At step S6, controller 5 determines one object which is the nearest one of the objects determined to be located on the predicted course. By these determinations at steps S5 and S6, an object which is the nearest one of all detected objected is not selected if it is not located on the predicted course.

At step S7 controller 5 determines a contact possibility (or collision possibility) between the selected nearest object and the host vehicle, and calculates the controlled quantity of the host vehicle if there is the contact possibility. More specifically, at step S7 controller 5 calculates a headway time THW between the host vehicle and the selected object using the following expression (5) in order to determine the contact possibility.

$$TWH=X/V \quad (5)$$

At step S8 controller 5 compares headway time TWH and a threshold Th. When controller 5 makes the negative determination at step S8, that is, when headway time TWH is smaller than threshold Th (THW<Th), controller 5 determines that there is the contact possibility, and the program proceeds to step S9 wherein controller 5 executes a calculation of the correction quantity. When controller 5 makes the affirmative determination at step S8, that is, when headway time TWH is greater than or equal to threshold Th (THW≧Th), controller 5 determines that there is not the contact possibility, and the program proceeds to step S11 wherein controller 5 sets the correction quantity at zero.

Figure 11A:
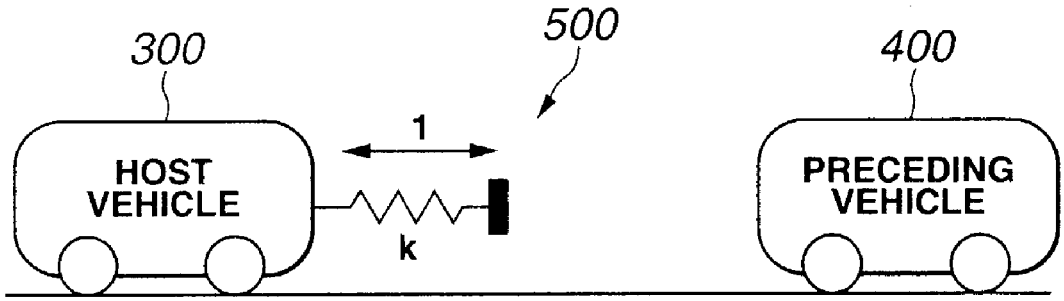
FIGS. 11A and 11B are views employed to explain a correction quantity calculation model where a virtual elastic member is provided ahead of the host vehicle.

The calculation of the correction quantity executed at step S9 is as follows. First it is assumed that an imaginary elastic member (virtual elastic member) 500 is connected at a front end of the host vehicle so as to be disposed between host vehicle 300 and a preceding vehicle 400 ahead of host vehicle 300, as shown in FIG. 11A. Further, there is formulated a model wherein when an inter-vehicle distance between host vehicle 300 and preceding vehicle 400 becomes smaller than or equal to a predetermined distance, virtual elastic member 500 is contacted with preceding vehicle 400 and is compressed. By this compression, a reaction force of virtual elastic member 500 functions as a virtual running resistance of host vehicle 300.

Herein, a length l of virtual elastic member 500 in this model is defined in association with host vehicle speed V and threshold Th as shown by the following expression (6).

$$l=Th\times Vh \quad (6)$$

Further, an elastic coefficient (elastic modulus) k of virtual elastic member 500 is a control parameter which is controllable so as to ensure a proper control advantage.

Figure 11B:
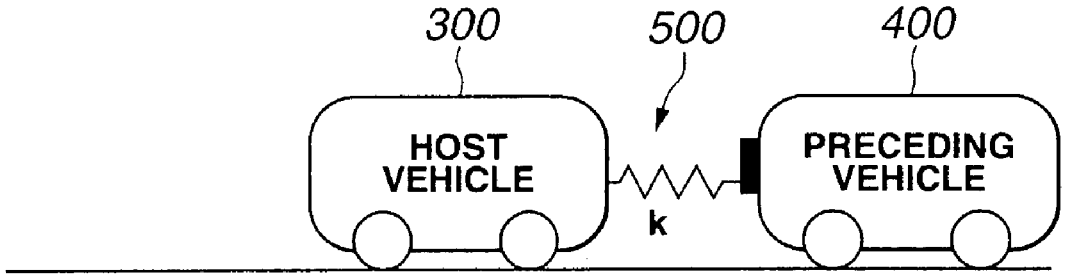

As shown in FIG. 11B, when the inter-vehicle distance between host vehicle 300 and preceding vehicle 400 is shorter than the length l of virtual elastic member 500, it is assumed that a reaction force Fc of virtual elastic member 500 is varied according to the inter vehicle distance X and is represented by the following expression (7).

$$Fc=k\times(l-X) \quad (7)$$

By employing the above-formulated model, when the inter-vehicle distance between host vehicle 300 and preceding vehicle 400 is smaller than reference distance l, virtual elastic member 500 having elastic modulus k generates reaction force Fc.

In the correction quantity calculation executed at step S9, controller 5 treats reaction force Fc of virtual elastic member 500 as a correction quantity. Hereinafter, it is called a reaction-force calculation correction quantity.

Further at step S10 subsequent to the execution of step S9 or S11, controller 5 outputs a correction quantity corresponding to the reaction-force calculation correction quantity which is one of reaction-force calculation correction quantity Fc calculated at step S9 and zero obtained at step S11, to driving force controller 10 and braking force controller 20.

Figure 12:
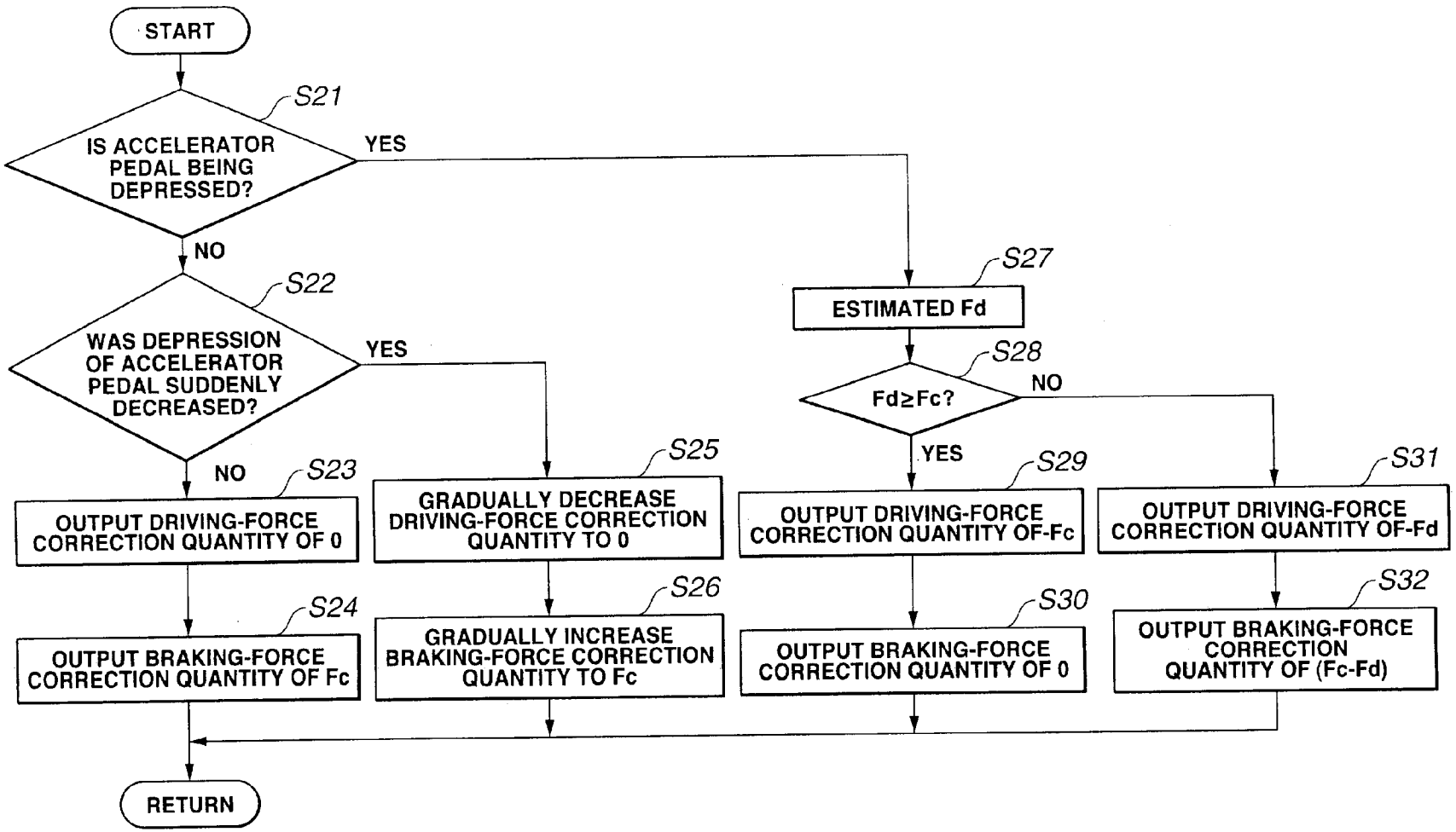
FIG. 12 is a flowchart showing a procedure of a correction quantity output processing executed in the processing of the correction quantity calculation.

The output processing executed at step S10 will be discussed with reference to a flowchart of FIG. 12.

At step S21 controller 5 determines whether or not accelerator pedal 4 is being depressed, on the basis of the information representative of the accelerator pedal depression quantity which has been read by controller 5. When the determination at step S21 is negative, that is when the accelerator pedal is not being depressed, the routine proceeds to step S22. When the determination at step S21 is affirmative, that is, when accelerator pedal 4 is being depressed, the routine proceeds to step S27.

At step S22 the controller determines whether or not accelerator pedal 4 was suddenly returned. More specifically, controller 5 calculates a return speed of accelerator pedal 4 from the information representative of the accelerator pedal depression quantity, and determines whether accelerator pedal 4 was suddenly returned or not, on the basis of the return speed of accelerator pedal 4. When the return speed is higher than a predetermined return speed, controller 5 makes the affirmative determination at step S22, and the program proceeds from step S22 to step S25.

When the return speed is smaller than the predetermined return speed, that is, when accelerator pedal 4 is not suddenly returned, controller 5 makes the negative determination at step S22, and the program proceeds to step S23.

At step S23 controller 5 outputs the driving force correction quantity set at zero to driving force controller 10, and at step S24 subsequent to the execution of step S23, controller 5 outputs reaction-force calculation correction quantity Fc as the braking-force correction quantity to braking force controller 20.

On the other hand, when the affirmative determination is made at step S22, that is, when controller 5 determines that the accelerator pedal was suddenly returned, the program proceeds to step S25.

Figure 13A:
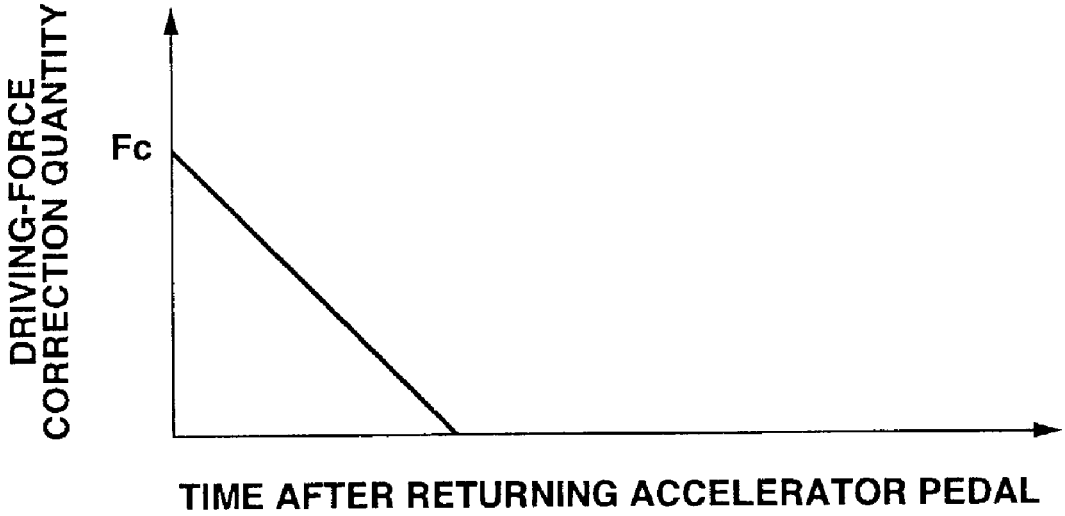
FIGS. 13A and 13B are graphs respectively showing a change of a driving force correction quantity and a change of the braking force correction quantity in case that an accelerator pedal is suddenly returned.

At step S25 controller 5 outputs a value, which is gradually decreased from reaction-force calculation correction quantity Fc to zero as time after returning accelerator pedal 4 elapses and is then maintained at zero as shown in FIG. 13A, as a driving force correction quantity to driving force controller 10.

Figure 13B:
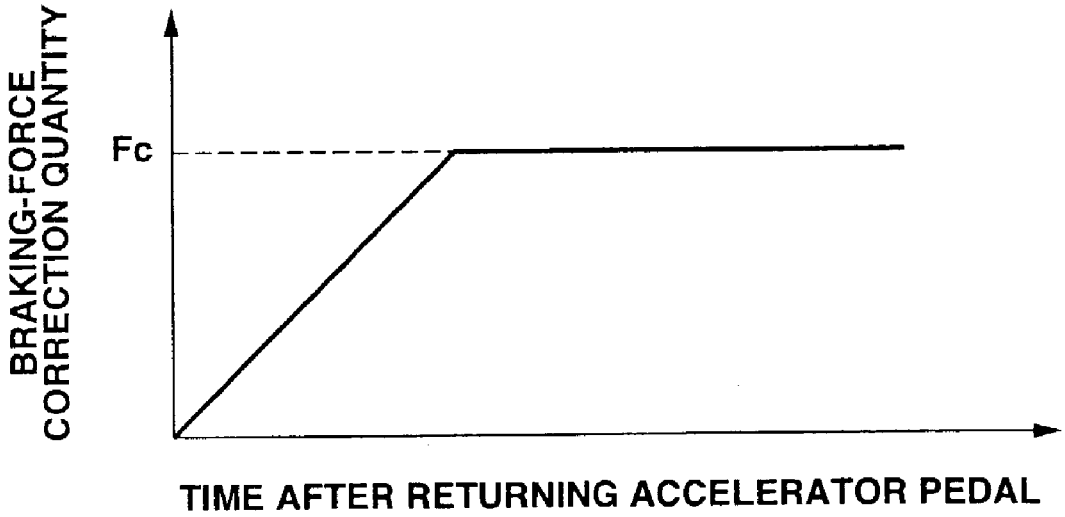

At step S26 subsequent to the execution of step S25, controller 5 outputs a value, which is gradually increased to reaction-force calculation correction quantity Fc and is then maintained at reaction-force calculation correction quantity Fc as shown in FIG. 13B, as a braking force correction quantity to braking force controller 20.

At step S27 subsequent to the affirmative determination at step S21, controller 5 estimates driver-demand driving force Fd. More specifically, controller 5 estimates driver-demand driving force Fd according to the accelerator depression quantity using the driver-demand driving-force calculation map shown in FIG. 3 which driving force controller 10 employs to calculate the driver-demand driving force.

At step S28 subsequent to the execution of step S27, controller 5 determines whether or not the estimated driver-demand driving force Fd is greater than or equal to reaction-force calculation correction quantity Fc. When the determination at step S28 is affirmative ($Fd \geqq Fc$), the program proceeds to step S29. When the determination step S28 is negative ($Fd < Fc$), the program proceeds to step S31.

At step S29 subsequent to the affirmative determination at step S28, controller 5 outputs a negative value $-Fc$ of reaction-force calculation correction quantity Fc as the driving force correction quantity to driving force controller 10, and at step S30 controller 5 outputs zero as a braking force correction quantity to braking force controller 20.

On the other hand, at step S31 subsequent to the negative determination at step S28, controller 5 outputs a negative value $-Fd$ of driver-demand driving force Fd as a driving force correction value to driving force controller 10, and at step S32 controller 5 outputs a value ($Fc-Fd$) obtained by subtracting driver-demand driving force Fd from reaction-force calculation correction quantity Fc as braking force correction quantity to braking force controller 20.

With the thus arranged correction quantity calculation process executed by controller 5, driving force controller 10 receives the value obtained by adding the driving force correction quantity to driver-demand driving force as the target driving force from controller 5, and braking force controller 20 receives the value obtained by adding the braking force correction quantity to driver-demand braking force as a target braking force from controller 5. As discussed above, controller 5 executes various processing.

The processing executed at steps S3 through S8 and radar device 30 and obstacle detection processor 2 construct contact possibility detecting means for detecting a possibility of contacting the host vehicle with an object ahead of the host vehicle. The contact possibility detecting means may be treated as detecting means for detecting a state of a circumstance in which the host vehicle is put. Further, the processing executed at steps S9 through S11 and the flowchart of FIG. 12 constructs first correcting means for correcting the generated driving force with respect to the manipulated quantity of accelerator manipulating means, on the basis of the detection result of the contact possibility detecting means.

Further, the processing executed at steps S31 and S32 by controller 5 constructs second correcting means for correcting the generated driving force with respect to the manipulated quantity of the brake control means when the manipulated quantity of accelerator pedal 4 is smaller than the predetermined manipulated quantity.

With the thus arranged construction, the cruise control system according to the present invention controls engine 6 through driving force controller 10 so as to generate the driving force according to the manipulated state of accelerator pedal 4 and controls the brake system through braking force controller 20 so as to generate the braking force according to the manipulated state of brake pedal 3.

On the other hand, the cruise control system is arranged to correct the controlled quantity varying according to the manipulated state, in response to the determination as to whether or not there exists a preceding vehicle which is located ahead of the host vehicle and has the contact possibility with the host vehicle. More specifically, the cruise control system according to the present invention is arranged to specify a preceding vehicle having the contact possibility on the basis of the obstacle information as to a preceding vehicle ahead of the host vehicle from the obstacle detection processor 2 according to radar device 30, the host vehicle information from vehicle speed sensor 1 and the steering angle information from steering angle sensor, to obtain reaction-force calculation correction quantity Fc from the model for executing the correction of the controlled quantity shown in FIG. 11 according to the inter-vehicle distance between the host vehicle and the selected preceding vehicle, to respectively obtain the driving force correction quantity and the braking force correction quantity according to the manipulated states of accelerator pedal 4 and brake pedal 3 using the reaction force calculation correction quantity Fc, and to control respectively engine 6 and the brake system using the target driving force corrected by the driving force correction quantity and the target braking force corrected by the braking force correction quantity.

The cruise control system according to the present invention is further arranged to obtain the driving force correction quantity and the braking force correction quantity according to the manipulated state produced by the driver, as follows.

As described above, when accelerator pedal 4 is not being depressed and when accelerator pedal 4 was not suddenly returned, controller 5 outputs zero as the driving force correction quantity to driving force controller 10, and outputs reaction-force calculation correction quantity Fc as the braking force correction quantity to braking force controller 20 by the execution of steps S23 and S24. Accordingly, braking force controller 20 produces the brake hydraulic pressures command according to the target braking force obtained by adding reaction-force calculation correction quantity Fc with the driver-demand braking force and executes the driving control using the brake system based on the brake hydraulic pressure command. This achieves the deceleration behavior of the host vehicle, and the driver of the host vehicle becomes aware of the approaching of the host vehicle to a preceding vehicle from the vehicle deceleration behavior functioning as an alarm information.

Further, when accelerator pedal 4 was suddenly returned, controller 5 outputs the driving force correction quantity which gradually decreases from reaction-force calculation correction quantity Fc to zero to driving force controller 10 by the execution of step S25 and outputs the braking force correction quantity which gradually increases from zero to reaction-force calculation correction quantity Fc to braking force controller 20 by the execution of step S26. That is, when accelerator pedal 4 is suddenly returned as a predetermined operation, by limiting the rate of decrease as to the generated quantity of the driving force and by limiting the rate of increase as to the generated quantity of the braking force, the limit to the correction is executed.

With this arrangement, the target driving force is gradually returned to the original value of the driver-demand driving force by correcting the driver-demand driving force using the driving force correction quantity at driving force controller 10. Further, the target braking force is gradually increased from the driver-demand braking force by correcting the driver-demand braking force using the braking force correction quantity at braking force controller 20. As a result, a slow deceleration behavior is achieved according to the returning acceleration pedal 4, and the driver can become aware of the approach of the host vehicle to a preceding vehicle from this deceleration behavior of the host vehicle.

Further, when accelerator pedal 4 is being depressed and when the estimation value of driver-demand force Fd corresponding to the depression quantity of accelerator pedal 4 is greater than reaction-force calculation correction quantity Fc, controller 5 outputs the negative value −Fc of reaction-force calculation correction quantity Fc as the driving force correction quantity to driving force controller 10 by the execution of step S29, and controller 5 outputs zero as the braking force correction quantity to braking force controller 20 by the execution of step S30. Accordingly, driving force controller 10 obtains the target driving force by adding the negative value −Fc to the driver-demand driving force and controls engine 6 so as to generate the target driving force.

By this arrangement, the actual driving force with respect to the driver-demand driving force becomes small by the reaction-force calculation correction quantity Fc. As a result, the host vehicle performs a slow acceleration behavior in response to the depressing manipulation of accelerator pedal 4 by the driver. That is, since the host vehicle is put in the condition that an expected acceleration according to the depression of accelerator pedal 4 is not provided, the driver can become aware of the approach of the host vehicle to a preceding vehicle from the slow acceleration functioning as the alarm information.

Further, when accelerator pedal 4 is depressed and when the estimated value of driver-demand driving force Fd corresponding to the depression quantity of accelerator pedal 4 is smaller than reaction-force calculation correction quantity Fc, controller 5 outputs the negative value −Fd of driver-demand driving force Fd estimated as the driving force correction quantity to driving force controller 10 by the execution of step S31, and controller 5 outputs the difference value (Fc−Fd) obtained by subtracting driver-demand driving force Fd from reaction-force calculation correction value Fc as the braking force correction quantity to braking force controller 20 by the execution of step S32.

Thus, by increasing and decreasing the correction quantity according to the increase and decrease of the driving force correction quantity, driving force controller 10 can obtain the target driving force obtained by adding the negative value −Fc of reaction-force calculation correction quantity Fc to the driver-demand driving force Fd and controls engine 6 so as to generate the target driving force. Further, braking force controller 20 can obtain the target braking force obtained by adding the difference value (Fc−Fd) to the driver-demand braking force and controls the brake system so as to generate the target braking force. That is, by executing this processing, the actual braking force becomes larger than the driver-demand braking force as accelerator pedal 4 is returned.

As a result of this processing, when the depression quantity of accelerator pedal 4 has not reached the predetermined quantity, the host vehicle performs a deceleration behavior. Therefore, the driver becomes aware of the approach of the host vehicle to a preceding vehicle from the deceleration behavior functioning as the alarm information.

Further, by this processing, when the estimate value of driver-demand driving force Fd with respect to the depression quantity of accelerator pedal 4 is smaller than reaction-force calculation correction quantity Fc (Fd<Fc), it becomes impossible to ensure reaction-force calculation correction quantity Fc as a target only by controlling driving force controller 10. Therefore, the negative value −Fd is outputted as the driving force correction quantity to driving force controller 10, and the difference value (Fc−Fd) is outputted as a shortage to braking force controller 20 so as to ensure reaction-force calculation correction quantity Fc. Further, by this processing, when the depression quantity of accelerator pedal 4 is smaller than the predetermined value, a slow braking according to the depression quantity of accelerator pedal 4 is executed and the relationship of the generated quantity of the braking force with respect to the depression quantity of brake pedal 3 is corrected toward the increased direction.

With the thus arranged cruise control system according to the present invention, driving force controller 10 and braking force controller 20 cooperate by managing the excess and shortage in driving force controller 10 and braking force controller 20 so as to ensure the reaction force Fc as a whole and applies the reaction force Fc as the running resistance to the host vehicle.

Accordingly, when the estimated value of driver-demand driving force Fd with respect to the depression quantity of accelerator pedal 4 is greater than or equal to reaction-force calculation correction quantity Fc (Fd≧Fc), the difference of the driver-demand driving force (Fd−Fc) is positive since Fd−Fc≧0. Even if driver-demand driving force Fd is corrected by subtracting reaction-force calculation correction quantity Fc as the driving force correction quantity from driver-demand driving force, the obtained difference of driver-demand driving force therefore takes a positive value. Consequently, the reaction force Fc is generated as a whole by setting the braking force correction quantity at zero so as not to depend on braking force controller 20 and by applying the negative value −Fc of reaction-force calculation correction quantity Fc as the driving force correction quantity to driver-demand driving force Fd so as to execute the correcting operation only at driving force controller 10. This generated reaction force Fc is applied to the host vehicle as the running resistance.

Figure 14:
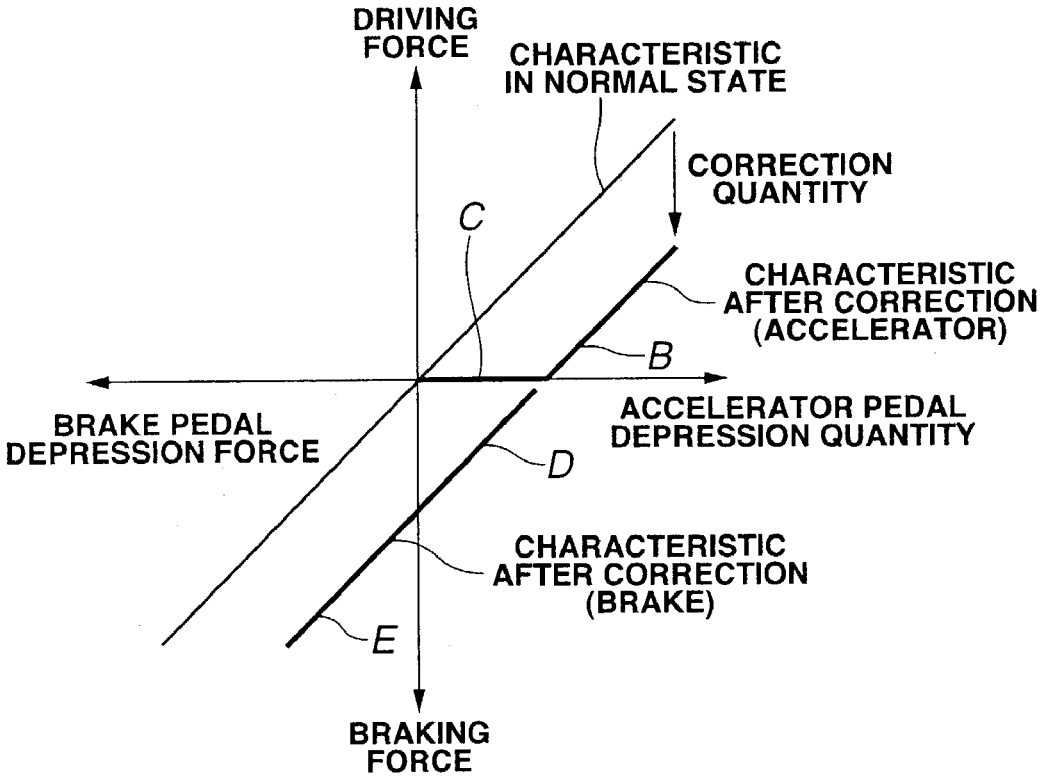
FIG. 14 is a graph employed to explain the characteristic of the driving force and the braking force which are corrected on the basis of a reaction-force calculation correction quantity Fc.

FIG. 14 is a graph showing a characteristic of the driving force and the braking force which are corrected on the basis of reaction-force calculation correction quantity Fc as discussed above.

As shown in FIG. 14, when the depression quantity of accelerator pedal 4 is greater than the predetermined quantity, the characteristic of the driving force in response to the depression quantity of accelerator pedal 4 is corrected so that the driving force is decreased by reaction-force calculation correction quantity Fc as shown by the line B in FIG. 14. On the other hand, when the depression quantity of accelerator pedal 4 is smaller than the predetermined quantity, the driving force is corrected to take zero as shown by the line C in FIG. 14, and simultaneously the braking force is corrected so that the braking force decreases according to the increase of the depression quantity of accelerator pedal 4 as shown by the line D in FIG. 14. Further, when brake pedal 3 is depressed, the braking force is corrected to increase the braking force by reaction-force calculation correction quantity Fc as shown by the line E in FIG. 14. The combination of the above-discussed corrections of the driving force and the braking force produces the characteristic that the running resistance of the host vehicle increases by the reaction-force calculation correction quantity (reaction force) Fc.

The first embodiment according to the present invention is arranged to correct the driver-demand driving force and the driver-demand braking force by calculating the reaction force of the virtual elastic member 500 provided ahead of the host vehicle according to the approaching state of the host vehicle to a preceding vehicle ahead of the host vehicle, by setting this virtual reaction force as the absolute correction quantity, and by outputting the driving force correcting quantity and the braking force correction quantity, by which the absolute correction quantity is achieved, to driving force controller 10 and braking force controller 20, respectively. By this correction of the driver-demand driving force and the driver-demand braking force, the acceleration of the host vehicle is set slow or the deceleration of the host vehicle is produced according to the reaction force so as to inform the driver that the host vehicle is approaching a preceding vehicle ahead of the host vehicle.

Further, the model employing the virtual elastic member is constructed so that the magnitude of the reaction force increases as the host vehicle approaches the preceding vehicle ahead of the host vehicle. Accordingly, the running resistance of the host vehicle due to the virtual elastic member increases as the host vehicle approaches the preceding vehicle, and the driver of the host vehicle becomes aware of the approaching of the host vehicle to the preceding vehicle from the continuous change of the running resistance according to the increase of the contact possibility of the host vehicle to the preceding vehicle. Further, the driver can estimate the degree of the contact possibility from the magnitude of the running resistance.

Further, since the alarm information to the driver is achieved by the deceleration of the host vehicle through correcting the driver-demand driving force, the driver-demand driving force is outputted although it is corrected when the driver depresses accelerator pedal 4. Accordingly, the driver's depression operation of accelerator pedal 4 is effectively reflected under this virtual elastic member operating condition. With this arrangement according to the present invention, it is possible to generate the driving force by increasing the depression quantity of accelerator pedal 4. That is, it is possible to accelerate the host vehicle by increasing the driving force greater than the reaction force of the virtual elastic member through the depressing operation of accelerator pedal 4. This enables the driver to control the host vehicle according to the driver's intention, such as to execute the avoiding control relative to the preceding vehicle, even when the reaction force due to the virtual elastic member is generated as the running resistance in the host vehicle. Consequently, the cruise control system according to the present invention is capable of executing an alarm informing operation without preventing the driver's ability to control the host vehicle.

Although the first embodiment has been shown and described such that the calculation of reaction-force calculation correction quantity Fc is executed by setting the virtual elastic member 500 at a front end of the host vehicle 300, the invention is not limited to this and may be arranged to calculate reaction-force calculation correction quantity Fc from other methods such as a method of employing a variable quantity which is represented by a function of the inter-vehicle distance and increases as the inter-vehicle distance decreases.

Figure 15:
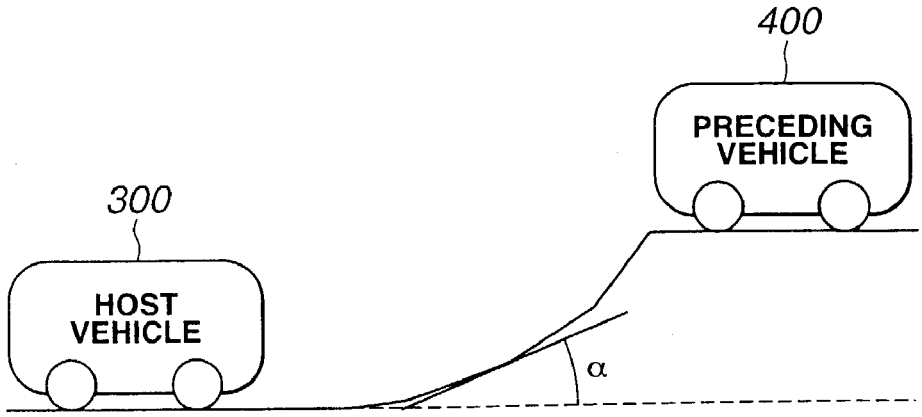
FIG. 15 is a view employed to explain a correction quantity calculation method employing a gradient $\alpha$ which varies according to an approaching condition of the host vehicle to a preceding vehicle.

For example, the correction quantity for the target driving force and the target brake force may be derived by employing a virtual gradient as if a virtual upslope exists ahead of the host vehicle when there exists a preceding vehicle ahead of the host vehicle, as shown in FIG. 15. When this virtual gradient is employed, a virtual gradient $\alpha$ is defined so as to vary according to the approaching state of the host vehicle to a preceding vehicle. Further, the correction quantity for the target driving force and the target braking force is defined using the gradient $\alpha$ as expressed by the following expression (8).

$$\text{Correction Quantity} = m \times \sin(\alpha) \tag{8}$$

Wherein m is a vehicle weight. That is, by employing this expression (8) and by setting the virtual gradient $\alpha$ so as to increase as the inter-vehicle distance decreases, the correction quantity increases as the inter-vehicle distance decreases.

Further, the correction quantity may be determined by previously having a lookup table for calculating the correction quantity varying according to the vehicle speed and the inter-vehicle distance and by retrieving the correction quantity from the lookup table based on the vehicle speed and the inter-vehicle distance. By employing such a lookup table, the derivation of the correction quantity is further facilitated.

In the explanation of the first embodiment according to the present invention, the threshold of the headway time may be set at a constant value, or at a variable which varies according to the change of the vehicle speed and the like.

Referring to FIGS. 16 through 23, there is shown a second embodiment of the cruise control system equipped with the information system according to the present invention. The second embodiment is arranged to adjust the reaction-force calculation correction quantity Fc in conjunction with the manipulating state achieved by the driver. The cruise control system of the second embodiment is basically the same as that of the first embodiment as far as it is not referred to, and the explanation thereof is omitted herein.

Figure 16:
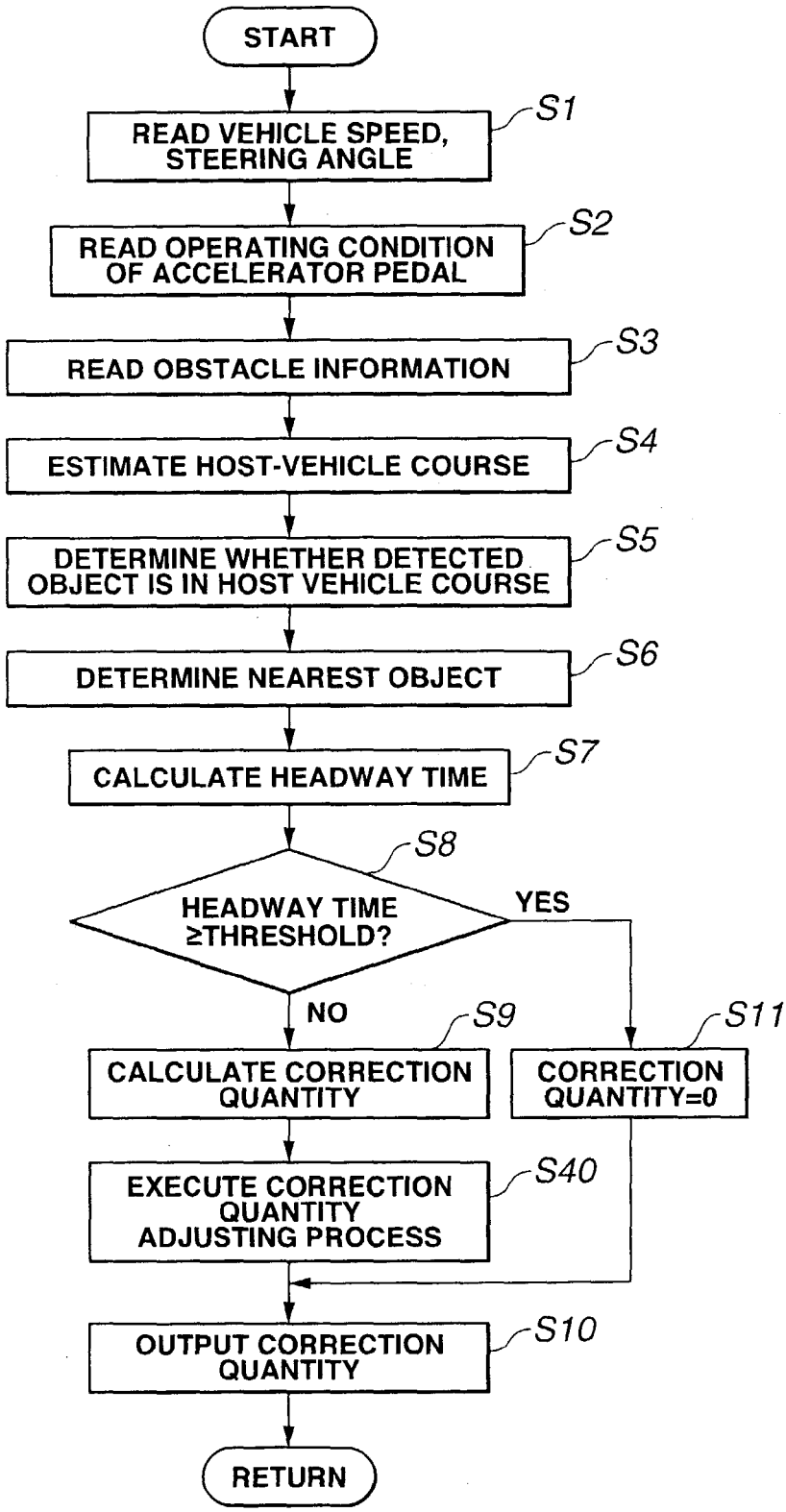
FIG. 16 is a flowchart showing a procedure for the calculation of a correction quantity by the controller of the cruise control system of a second embodiment.

The cruise control system of the second embodiment comprises a correction quantity adjusting means for adjusting the correction quantity in conjunction with the manipulating state of accelerator pedal 4 and brake pedal 3. With reference to a flowchart of FIG. 16, there will be discussed the control processing executed by controller 5 having the correction quantity adjusting means. The flowchart of FIG. 16 shows the processing procedure of controller 5 having the correction quantity adjusting means and is specifically arranged to execute a correction quantity adjusting process at step S40 subsequent to the step S9 of executing the correction quantity calculating process, in addition to the processing of the flowchart of FIG. 8.

Figure 17:
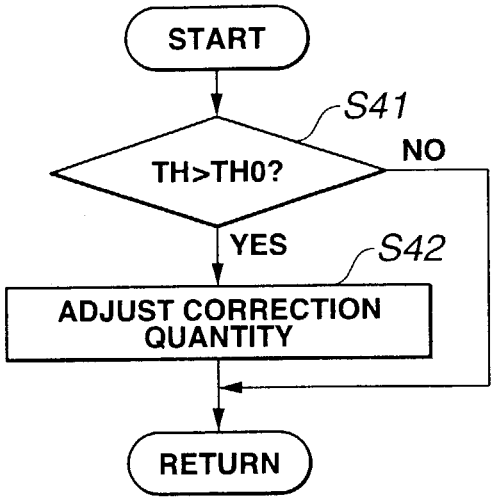
FIG. 17 is a flowchart showing a procedure of a correction quantity adjusting processing executed in the processing of the correction quantity calculation of FIG. 16.

FIG. 17 is a flowchart showing a concrete processing procedure of the correction quantity adjusting process executed at step S40.

At step S41 controller 5 compares the depression quantity TH of accelerator pedal 4 with a predetermined threshold TH0. When the depression quantity TH is greater than threshold TH0 (TH>TH0), the routine proceeds to step S42 wherein controller 5 executes the correction quantity adjusting process for decreasing reaction-force calculation correction quantity Fc. More specifically, at step S42, controller 5 decreases the correction quantity by obtaining a new reaction-force calculation correction quantity Fc by multiplying reaction-force calculation correction quantity Fc obtained at step S9 by a correction coefficient al as expressed by the following expressions (9) and (10).

$$\alpha 1=(Th\max-TH)/(Th\max-TH0) \quad (9)$$

$$Fc=Fc\cdot\alpha 1 \quad (10)$$

These expressions (9) and (10) are employed under a condition of TH>TH0, and Thmax in the expression (9) is a maximum depression quantity. By employing these expressions (9) and (10), reaction-force calculation correction quantity Fc is set to decrease as the depression quantity TH of accelerator pedal 4 increases under the condition of TH>TH0.

Further, when depression quantity TH is smaller than or equal to threshold TH0 (TH<TH0), the routine jumps to a return block to terminate this routine and to return the routine to the main program of FIG. 16. That is, when the determination at step S41 is negative, reaction-force calculation correction quantity Fc is maintained and the routine proceeds to step S10 of FIG. 16. This correction quantity adjusting process obtains the new reaction-force calculation quantity Fc.

At step S10 subsequent to the execution of step S40 or S11, controller 5 executes the outputting process as is similar to the execution in the first embodiment. That is, controller 5 properly determines the driving force correction quantity and the braking force correction quantity according to the newly determined reaction-force calculation correction quantity Fc and controls the driving force and the braking force in a manner of the processing procedure shown in FIG. 12.

With the cruise control system of the second embodiment, when the depression quantity of accelerator pedal 4 is greater than a predetermined value, reaction-force calculation correction quantity Fc is decreased, and further the degree of decrease of the reaction-force calculation correction quantity Fc is determined according to the depression quantity of accelerator pedal 4. By these arrangements as to the correction quantity Fc, when the depression quantity of accelerator pedal 4 is greater than the predetermined value, the influence of the correction to the driving force is suppressed, and therefore the driving force characteristic under this state becomes approximately similar to the driving force characteristic under the normal state. Accordingly, the driver ensures the acceleration of the host vehicle as is similar to that in the normal state by depressing accelerator pedal 4 even under a condition that the correction operation of the driving force is being executed.

Figure 18:
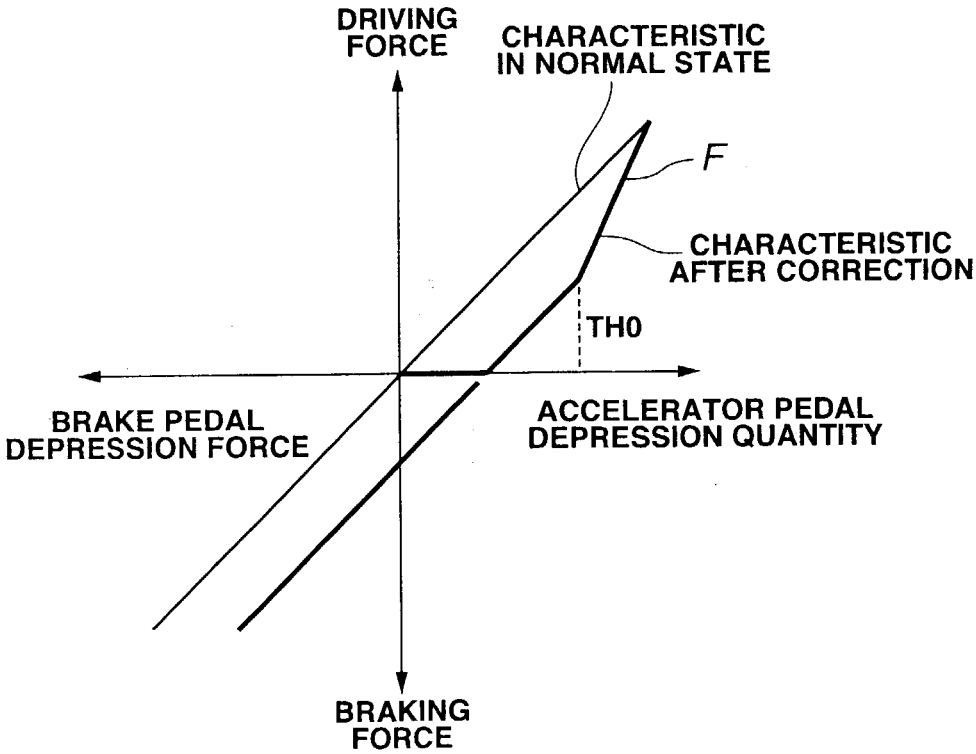
FIG. 18 is a graph employed to explain the characteristic of the driving force and the braking force which are corrected on the basis of a reaction-force calculation correction quantity Fc.
Figure 19:
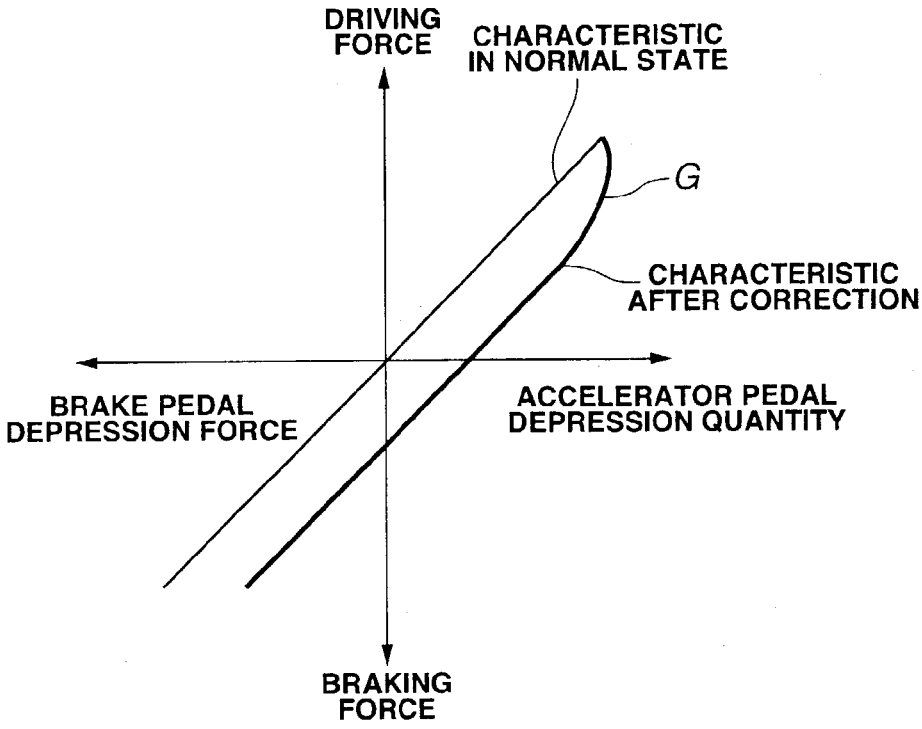
FIG. 19 is a graph employed to explain the characteristic of the driving force and the braking force which are corrected on the basis of a reaction-force calculation correction quantity Fc so that the driving force performs a further free characteristic as compared with the characteristic in FIG. 18.

FIG. 18 is a graph showing the characteristic of the driving force and the braking force which are corrected in the above-discussed manner of the second embodiment.

As shown in FIG. 18, when the depression quantity of accelerator pedal 4 is greater than predetermined threshold TH0, the characteristic of the driving force according to the depression quantity of accelerator pedal 4 is corrected so as to be very similar to the characteristic of the driving force in the normal state as shown by the line F in FIG. 18.

Although the second embodiment has been shown and described such that the adjustment of reaction-force calculation correction quantity Fc is executed using the expressions (9) and (10), the invention is not limited to this method. For example, a lookup table, which defines a decreased quantity (correction coefficient of the correction quantity) according to the depression quantity, may be employed for executing the adjustment of reaction-force calculation correction quantity Fc. With this arrangement employing the lookup stable, as shown by a graph in FIG. 19, when the depression quantity TH of accelerator pedal 4 is greater than threshold TH0, the characteristic of the driving force can be set to be similar to the characteristic in the normal state with a further greater degrees of freedom, particularly as shown by the line G in FIG. 19.

Figure 20:
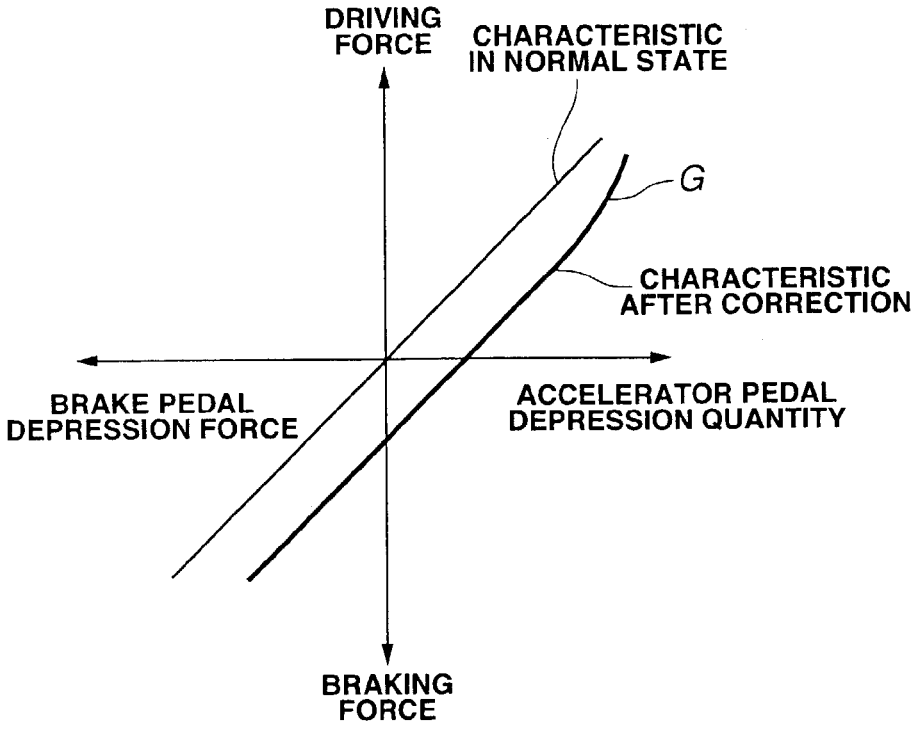
FIG. 20 is a graph employed to explain the characteristic of the driving force and the braking force which are corrected on the basis of a reaction-force calculation correction quantity Fc so that the acceleration of the host vehicle is slowed even when the depression quantity of the accelerator pedal is large.

Further, reaction-force calculation correction quantity Fc may not be set at zero even when accelerator pedal 3 is fully depressed. For example, as shown in FIG. 20, when the depression quantity of accelerator pedal 4 is greater than the predetermined value, the decreased quantity of reaction-force calculation correction quantity Fc is decreased so that the acceleration of the host vehicle is slowed against the driver's intent.

Further although the second embodiment according to the present invention has been shown and described such that reaction-force calculation correction quantity Fc derived from the virtual elastic member is treated as an adjusted object, the invention is not limited to this, and the gradient $\alpha$ explained in the first embodiment may be treated as the adjusted object.

Furthermore, although the second embodiment has been shown and described such that the depression quantity of accelerator pedal 4 is a parameter indicative of the driver's manipulation state, according to which reaction-force calculation correction quantity Fc is adjusted, the invention is not limited to this. That is, a depression speed of accelerator pedal 4 may be employed as a parameter indicative of the driver's manipulation state, and reaction-force calculation correction quantity Fc may be adjusted according to the depression speed of accelerator pedal 4.

Figure 21:
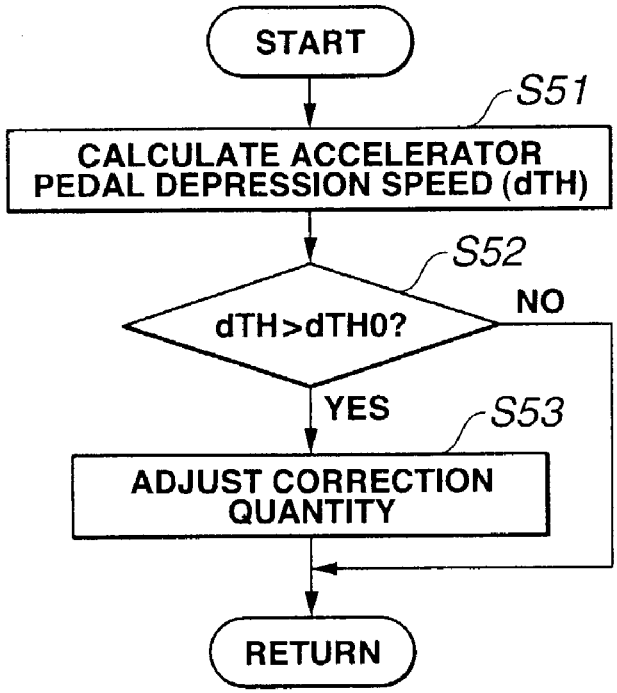
FIG. 21 is a flowchart showing a procedure of the correction quantity adjusting processing executed in the processing of the correction quantity calculation of the second embodiment.

FIG. 21 shows a concrete procedure of the above-discussed correction quantity adjustment processing and may be executed at step S40 in FIG. 16 instead of the processing shown in FIG. 17.

At step S51 controller 5 calculates depression speed dTH on the basis of the information indicative of depression quantity TH of accelerator pedal 4. Herein, the depression speed dTH can be obtained by executing a difference processing of the depression quantity varied along the time series and by executing the smoothing process of the obtained data, or may be obtained by executing a pseudo-differential filtering process as to the obtained data.

At step S52 controller 5 compares depression speed dTH and a predetermined threshold dTH0. When depression speed dTH is greater than threshold dTH0 (dTH>dTH0), the program proceeds to step S53 wherein controller 5 executes the correction quantity adjustment process for decreasing reaction-force calculation quantity Fc.

Figure 22:
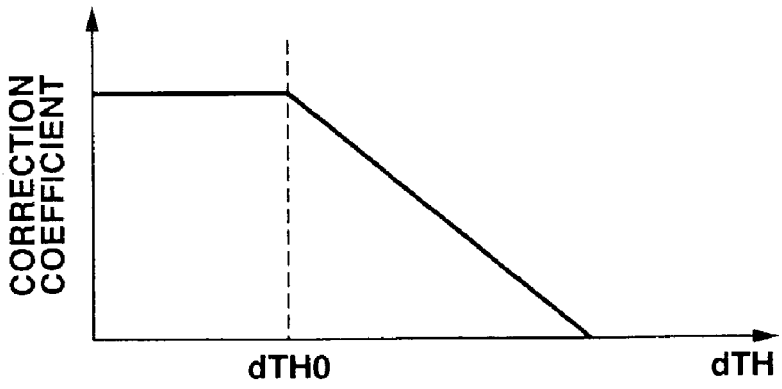
FIG. 22 is a graph showing a correction coefficient varying according to a depression speed dTH of the accelerator pedal.

The correction quantity is decreased according to the magnitude of depression speed dTH by the execution of the correction quantity adjustment process. The decease of the correction quantity is achieved using a lookup table which has previously defined the decreased quantity (correction coefficient of the correction quantity) according to the depression speed dTH. For example, as shown in FIG. 22, the correction coefficient has been previously set so as to vary according to the depression speed dTH when the depression speed dTH is greater than the threshold dTH0. Further, controller 5 obtains a new reaction-force calculation correction quantity Fc by multiplying this correction coefficient and reaction-force calculation correction quantity Fc obtained at step S9 in FIG. 16.

On the other hand, when depression speed dTH is smaller than or equal to threshold dTH0 (dTH≦dTH0), the program proceeds to a return block without executing the adjustment of the correction quantity to terminate the present subroutine. That is, the reaction-force calculation correction quantity Fc calculated at step S9 is maintained and the program in FIG. 16 proceeds to step S10. Thus, the reaction-force calculation correction quantity Fc may be adjusted on the basis of the depression speed dTH to obtain a new reaction-force calculation correction quantity Fc.

With the thus arranged cruise control system, since reaction-force calculation correction quantity Fc is adjusted according to the depression speed dTH of accelerator pedal 4, even if the depression quantity TH is not greater than the predetermined value, it becomes possible to quickly recover the driving force and to accelerate the host vehicle.

Figure 23:
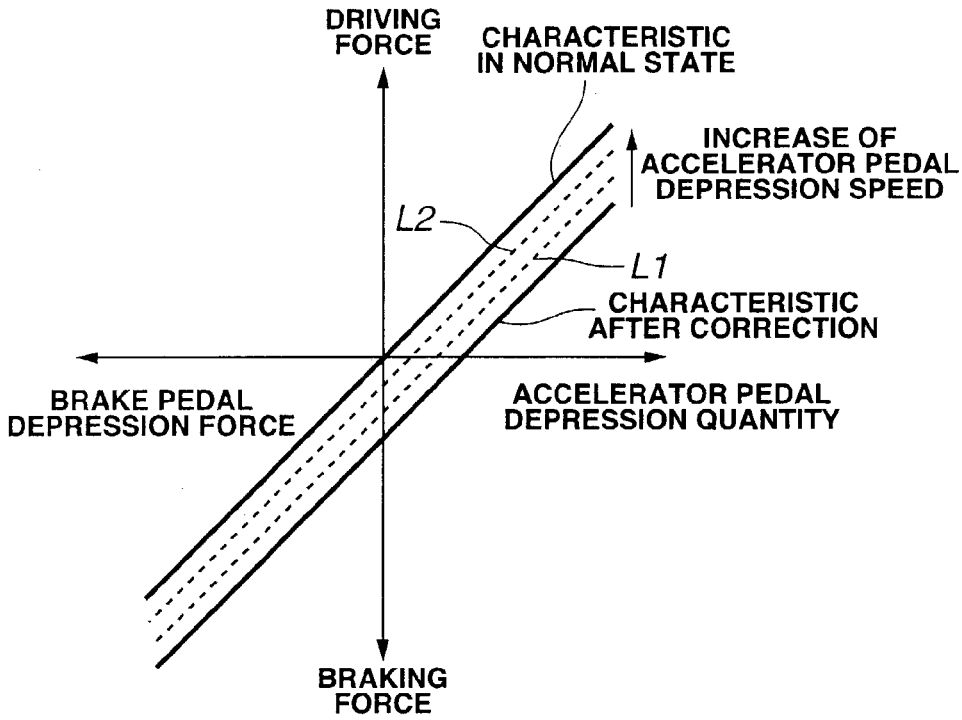
FIG. 23 is a graph employed to explain the characteristic of the driving force and the braking force in case that reaction-force calculation correction quantity Fc is adjusted according to the depression speed of the accelerator pedal.

FIG. 23 shows a characteristic of the driving force and the braking force to which the correction using the depression speed dTH is adapted. As is clear from FIG. 23, the characteristic of the driving force and the braking force is varied from the side of the dotted line L1 toward a side of the dotted line L2 as the depression speed dTH increases. That is, the characteristic of the driving force and the braking force to be corrected approaches the characteristic in the normal state as the depression speed dTH increases.

Referring to FIGS. 24 through 28, there is shown a third embodiment of the cruise control system equipped with the information system according to the present invention.

This cruise control system equipped with the information system of the third embodiment is arranged to determine the braking force correction quantity based on reaction-force calculation correction quantity Fc upon taking account of the depression force of brake pedal 3. The construction of the cruise control system of the third embodiment is basically the same as that of the first embodiment as far as it is not specifically explained, and the explanation thereof is omitted herein.

Figure 24:
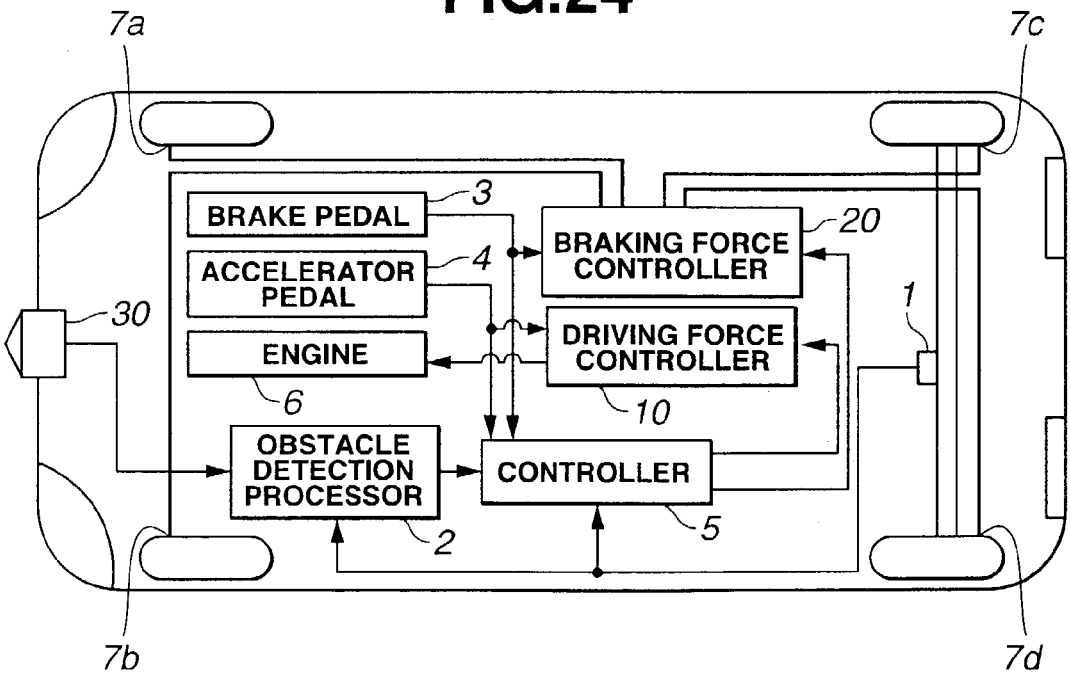
FIG. 24 is a schematic view showing a construction of the cruise control system of a third embodiment according to the present invention.

As shown in FIG. 24, the cruise control system of the third embodiment is arranged such that controller 5 receives the depression force of brake pedal 3 in addition to the depression quantity of accelerator pedal 4.

Figure 25:
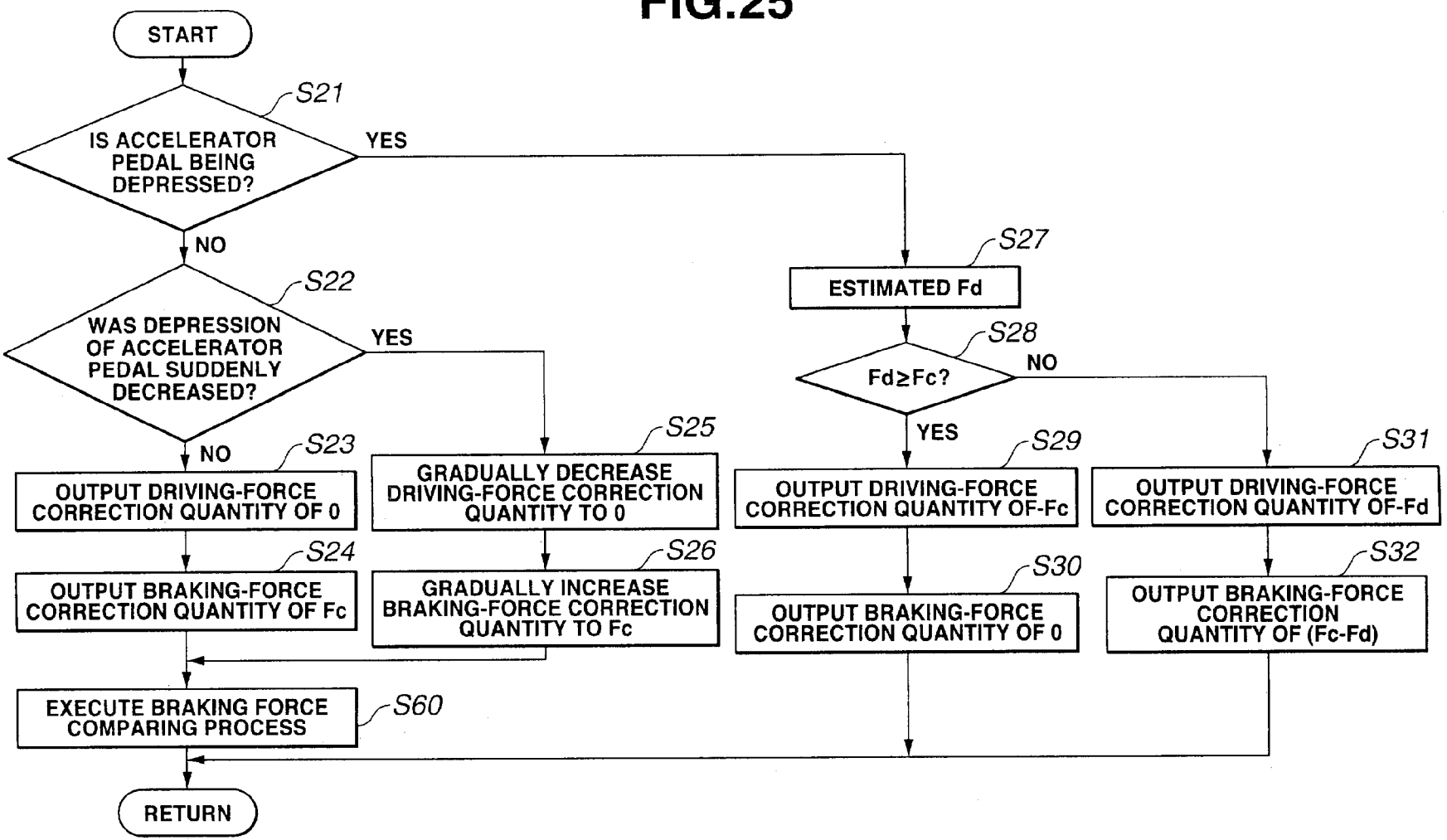
FIG. 25 is a flowchart showing a procedure of the correction quantity output processing executed in the processing of the correction quantity calculation in the third embodiment.

A flowchart of FIG. 25 shows a processing procedure executed by controller 5 employed in the third embodiment and is the correction quantity outputting process for outputting reaction-force correction quantity Fc executed at step S10 in FIG. 8. As shown in FIG. 25, the processing is specifically arranged to execute step S60 subsequent to the execution of step S24 or S26. At step S60, controller 5 executes a braking force comparing process. There will be discussed a detailed procedure of the braking force comparing process executed at step S60 with reference to a flowchart of FIG. 26.

Figure 26:
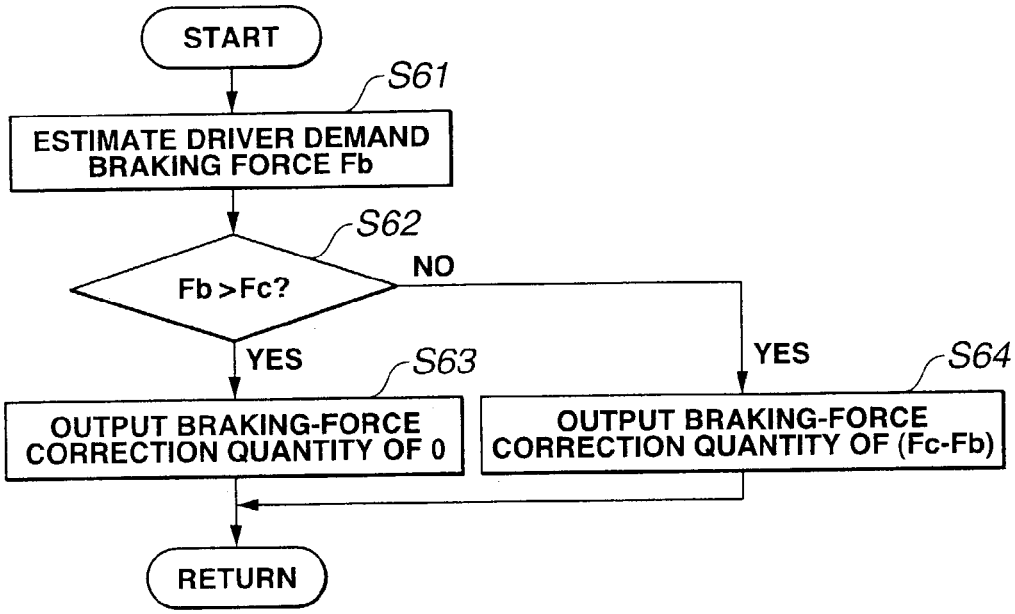
FIG. 26 is a flowchart showing a procedure of the correction quantity comparing processing executed in the correction quantity outputting processing of the third embodiment.

At step S61 in FIG. 26, controller 5 estimates driver-demand braking force Fb according to the depression force of brake pedal 3 by retrieving the driver-demand braking force calculation map shown in FIG. 5.

At step S62 controller 5 determines whether or not the estimated driver-demand braking force Fb is greater than reaction-force calculation correction quantity Fc. When the determination at step S62 is affirmative (Fb>Fc), the program proceeds to step S63. When the determination at step S62 is negative (Fb≦Fc), the program proceeds to step S64.

At step S63 controller 5 outputs zero as a braking force correction quantity to braking force controller 20.

At step S64 controller 5 outputs a difference value (Fc−Fb) obtained by subtracting driver-demand braking force Fb from reaction-force calculation correction quantity Fc as a braking force correction quantity to braking force controller 20.

With the braking force comparing process executed by controller 5, when the estimated driver-demand braking force Fb is greater than reaction-force calculation correction quantity Fc (Fb>Fc), that is, when the braking force demanded by the driver is greater than reaction force calculation correction quantity Fc, the braking force correction quantity is set at zero. Further when the estimated driver-demand braking force Fb is smaller than or equal to reaction-force calculation correction quantity Fc (Fb≦Fc), that is, when reaction-force calculation correction quantity Fc is greater than the braking force demanded by the driver, the braking force correction quantity is set at the difference value (Fc−Fb).

By this arrangement of the braking force correction quantity, when the driver depresses brake pedal 3 and when the depression force of brake pedal 3 is greater than reaction-force calculation correction quantity Fc, by setting the braking force correction quantity at zero, the operation of reaction-force calculation correction quantity Fc is canceled or prohibited, and the braking force Fb demanded by the driver is employed with a priority. Accordingly, the braking force according to the driver's intent is generated.

On the other hand, even when the driver depresses brake pedal 3 and when the depression force of brake pedal 3 is smaller than a predetermined threshold, by setting the difference value (Fc−Fb) as a braking force correction quantity, the braking force demanded by the driver is increased by the difference value (Fc−Fb) so as to obtain the braking force corresponding to reaction-force calculation correction quantity Fc.

Figure 27:
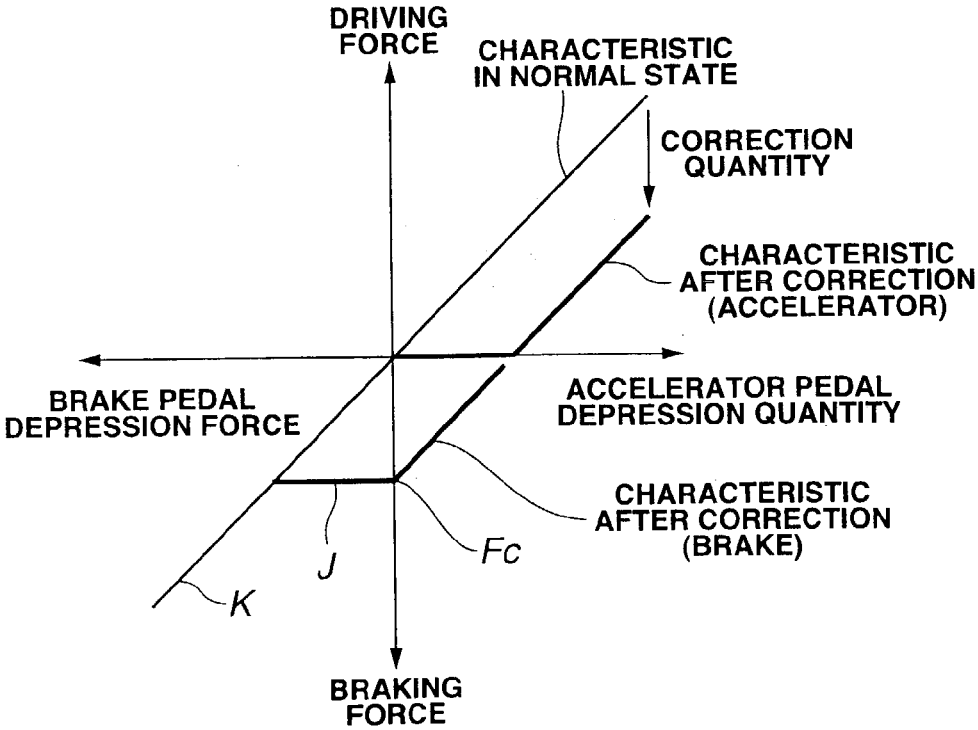
FIG. 27 is a graph employed to explain the characteristic of the driving force and the braking force of the cruise control system in the third embodiment, which is arranged such that the braking force performs the characteristic corresponding to the driver-demand braking force when the depression force is greater than a predetermined value.

FIG. 27 shows a characteristic of the driving force and the braking force based on the above-discussed processing. As shown in FIG. 27, when brake pedal 3 is depressed, the characteristic of the braking force is corrected by reaction-force calculation correction quantity (reaction force) Fc as shown by the line J in FIG. 27. When the depression force of brake pedal 3 becomes greater than or equal to a predetermined value, the operation of reaction-force calculation correction quantity (reaction force) Fc is cancelled or prohibited, and therefore the characteristic of the braking force is set at the characteristic corresponding to braking force Fb demanded by the driver as shown by the line K in FIG. 27.

With this arrangement according to the third embodiment of the present invention, it becomes possible that the cruise control system further improves the degree of freedom in the manipulation of the host vehicle by the driver while maintaining the alarm information function to the driver.

Figure 28:
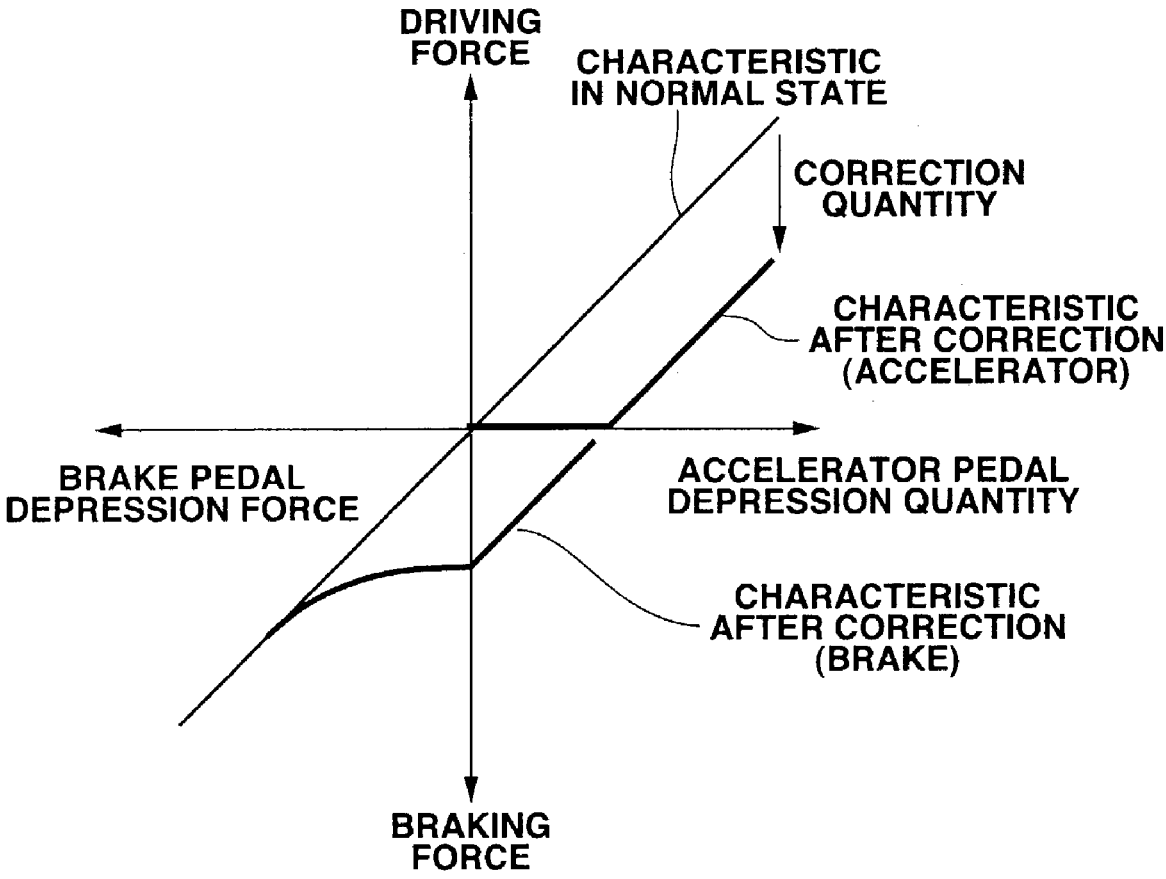
FIG. 28 is a graph employed to explain the characteristic of the driving force and the braking force of the cruise control system in the third embodiment, which is arranged such that the braking force is smoothly varied from the braking force corresponding to the reaction-force calculation correction quantity to the driver-demand braking force.

Further, the characteristic of the braking force may be designed, as shown in FIG. 28, such that the braking force correction quantity is determined so as to smoothly vary the transient range from the braking force corresponding to reaction-force calculation correction quantity Fc to the braking force corresponding to driver-demand braking force Fb instead of the line J in FIG. 27.

Although the embodiments according to the present invention have been shown and described as to a case that the generated quantity of the driving force is corrected to be decreased and the generated quantity of the braking force is corrected to be increased, the corrections of the generated quantities of the driving force and the braking force is not limited to this.

Further although the embodiments according to the present invention have been shown and described to correct the generated quantity of the driving force with respect to the depression quantity of accelerator pedal 4, the invention is not limited to this. For example, the correction of the generated quantity of the driving force with respect to the depression quantity of accelerator pedal 4 may be executed on the basis of a detection result of an environment of the host vehicle.

For example, this environment includes a condition of the host vehicle and the environment around the host vehicle. More specifically, the environment around the host vehicle is a traveling environment including the condition of a traveling road such as a skiddy road. Therefore, by detecting the road surface condition, the generated quantity of the driving force with respect to the depression quantity of accelerator pedal 4 is corrected upon taking account of the detected road surface condition.

Further, it may be defined that the vehicle traveling environment includes a situation that there is a contact possibility of the host vehicle to a preceding vehicle ahead of the host vehicle. Further, even when the generated quantity of the driving force in response to the depression quantity of accelerator pedal 4 is corrected on the basis of the environment of the host vehicle and when the manipulated quantity of accelerator pedal 4 is smaller than a predetermined manipulated quantity, the generated quantity of the driving force may be corrected by correcting the generated quantity of the braking force. By this correction, it is possible to put the traveling condition of the host vehicle in a desired condition.

This application is based on a prior Japanese Patent Application No. 2002-181150. The entire contents of the Japanese Patent Application No. 2002-181150 with a filing date of Jun. 21, 2002 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An information system for a host vehicle, comprising:

an accelerator manipulation detecting device that detects an accelerator manipulation quantity of an accelerator according to which a driver demand driving force is generated by an internal combustion engine;

an object detecting unit that detects an object ahead of the host vehicle; and a controller connected to the accelerator manipulation detecting device and the object detecting unit, the controller being configured, to determine a contact possibility that the host vehicle will contact with an object ahead of the host vehicle, on the basis of information from the object detecting unit, and to correct a driving-force relationship between the driver demand driving force and the accelerator manipulation quantity according to the contact possibility, wherein the controller is further configured to increase the driver demand driving force with respect to the accelerator manipulation quantity when the accelerator manipulation quantity is greater than a predetermined quantity.

2. The information system as claimed in claim 1, wherein the controller is further configured to decrease the driver demand driving force with respect to the accelerator manipulation quantity as the contact possibility increases.

3. A vehicle comprising the information system claimed in claim 1.

4. An information system for a host vehicle, comprising:

an accelerator manipulation detecting device that detects an accelerator manipulation quantity of an accelerator according to which a driver demand driving force is generated by an internal combustion engine;

an object detecting unit that detects an object ahead of the host vehicle; and a controller connected to the accelerator manipulation detecting device and the object detecting unit, the controller being configured, to determine a contact possibility that the host vehicle will contact with an object ahead of the host vehicle, on the basis of information from the object detecting unit, and to correct a driving-force relationship between the driver demand driving force and the accelerator manipulation quantity according to the contact possibility, wherein the controller is further configured to increase the driver demand driving force with respect to the accelerator manipulation quantity when a rate of change of the accelerator manipulation quantity is greater than or equal to a predetermined rate, as compared with the driver demand driving force with respect to the acceleration manipulation quantity in a condition that the rate of change of the accelerator manipulation quantity is smaller than the predetermined rate.

5. An information system for a host vehicle, comprising:

an accelerator manipulation detecting device that detects an accelerator manipulation quantity of an accelerator according to which a driver demand driving force is generated by an internal combustion engine;

a brake manipulation detecting device that detects a brake manipulation quantity of a brake manipulation device according to which a driver demand braking force is generated by a brake system;

an object detecting unit that detects an object ahead of the host vehicle; and a controller connected to the accelerator manipulation detecting device and the object detecting unit, the controller being configured, to determine a contact possibility that the host vehicle will contact with an object ahead of the host vehicle, on the basis of information from the object detecting unit;

to correct a driving-force relationship between the driver demand driving force and the accelerator manipulation quantity according to the contact possibility, and to correct a braking-force relationship between the driver demand braking force and the brake manipulation quantity when the accelerator manipulation quantity is smaller than a predetermined manipulation quantity.

6. The information system as claimed in claim 5, wherein the controller is further configured to vary a degree of a correction of the braking-force relationship according to a degree of the correction of the driving-force relationship.

7. The information system as claimed in claim 5, wherein the controller is further configured to increase the driver demand braking force with respect to the brake manipulation quantity.

8. The information system as claimed in claim 5, wherein the controller is further configured to limit correcting the driving-force relationship and the braking-force relationship when a manipulation of the accelerator corresponds to a predetermined manipulation.

9. The information system as claimed in claim 8, wherein the predetermined manipulation is a manipulation for suddenly decreasing the accelerator manipulation quantity, and the limitation of correcting the driving-force relationship is a limitation of a rate of decrease of the driver demand driving force with respect to the accelerator manipulation quantity, and the limitation of correcting the braking-force relationship is a limitation of a rate of increase of the driver demand braking force with respect to the brake manipulation quantity.

10. The information system as claimed in claim 5, wherein the controller is further configured to determine the contact possibility on the basis of a host-vehicle speed, a relative speed between the host-vehicle speed and a preceding-object speed, and a distance between the the host vechicle and an object ahead of the host vehicle.

11. A vehicle comprising the information system claimed in claim 5.

12. The information system as claimed in claim 5, wherein the controller is further configured to estimate a near-future host vehicle course on the basis of a host vehicle speed and a steering angle.

13. The information system as claimed in claim 12, wherein the controller is further configured to determine the contact possibility when the host vehicle travels the estimated near-future host vehicle course.

14. An information system for a host vehicle, comprising:

an accelerator manipulation detecting device that detects an accelerator manipulation quantity of an accelerator according to which a driver demand driving force is generated by an internal combustion engine;

a brake manipulation detecting device that detects a brake manipulation quantity of a brake manipulation device according to which a driver demand braking force is generated by a brake system;

an object detecting unit that detects an object ahead of the host vehicle; and a controller connected to the accelerator manipulation detecting device and the object detecting unit, the controller being configured, to determine a contact possibility that the host vehicle will contact with an object ahead of the host vehicle, on the basis of information from the object detecting unit, to correct a driving-force relationship between the driver demand driving force and the accelerator manipulation quantity according to the contact possibility, and to correct a braking-force relationship between the driver demand braking force and the brake manipulation quantity when the accelerator manipulation quantity is smaller than a predetermined manipulation quantity, wherein on the assumption that a virtual force applied to the host vehicle is generated so as to increase as a distance between the host vehicle and an object having a possibility of contacting with the host vehicle decreases, the controller is configured to correct the driving-force relationship and the braking-force relationship so that a sum of a decreased quantity of the driver demand driving force and an increased quantity of the driver demand braking force is equal to the virtual force, wherein the decreased quantity of the driver demand driving force is a quantity generated by decreasing the driver demand driving force with respect to the accelerator manipulation quantity and the increased quantity of the driver demand braking force is a quantity generated by increasing the driver demand braking force with respect to the brake manipulation quantity.

15. The information system as claimed in claim 14, wherein the virtual force is a reaction force of a virtual elastic member which is compressed according to the distance between the host vehicle and the object.

16. The information system as claimed in claim 14, wherein the virtual force is a running resistance which is applied to the host vehicle when the host vehicle travels on a virtual upslope whose gradient varies according to the distance between the host vehicle and the object.

17. A method of informing a contact possibility of a host vehicle with an object ahead of the host vehicle, comprising:

determining a contact possibility that the host vehicle will contact with an object ahead of the host vehicle;

correcting a driving-force relationship between a driver demand driving force and an accelerator manipulation quantity according to the contact possibility; and increasing the driver demand driving force with respect to the accelerator manipulation quantity when the accelerator manipulation quantity is greater than a predetermined quantity.

18. The method as claimed in claim 17, wherein the operation of correcting the driving-force relationship includes an operation of decreasing the driver demand driving force with respect to the accelerator manipulation quantity as the contact possibility increases.

19. A method of informing a contact possibility of a host vehicle with an object ahead of the host vehicle, comprising:

determining a contact possibility that the host vehicle will contact with an object ahead of the host vehicle;

correcting a driving-force relationship between a driver demand driving force and an accelerator manipulation quantity according to the contact possibility; and correcting a braking-force relationship between a driver demand braking force and a brake manipulation quantity when the accelerator manipulation quantity is smaller than a predetermined manipulation quantity.

20. The method as claimed in claim 19, wherein the operation of correcting the braking-force relationship includes an operation of increasing the driver demand braking force with respect to the brake manipulation quantity.

21. The method as claimed in claim 19, further comprising an operation of correcting the driving-force relationship and the braking-force relationship so that a sum of a decreased quantity of the driver demand driving force and an increased quantity of the driver demand braking force is equal to a virtual force when it is assumed that the virtual force applied to the host vehicle is generated so as to increase as a distance between the host vehicle and an object having a possibility of contacting with the host vehicle decreases, wherein the decreased quantity of the driver demand driving force is a quantity generated by decreasing the driver demand driving force with respect to the accelerator manipulation quantity and the increased quantity of the driver demand braking force is a quantity generated by increasing the driver demand braking force with respect to the brake manipulation quantity.

22. A method of informing a contact possibility of a host vehicle with an object ahead of the host vehicle, comprising:

detecting an environment of the host vehicle;

correcting a driving-force relationship between a driver demand driving force and an accelerator manipulation quantity according to the detected environment; and correcting a braking-force relationship between a driver demand braking force and a brake manipulation quantity when the accelerator manipulation quantity is smaller than a predetermined manipulation quantity.

23. The method as claimed in claim 22, wherein the environment includes at least one of a state of the host vehicle itself and an environment around the host vehicle.

24. An information system for a host vehicle, the host vehicle being equipped with an engine controller for controlling an internal combustion engine so as to generate a driving force according to an accelerator manipulation quantity of an accelerator manipulating means and a brake controller for controlling a brake system so as to generate a braking force according to a brake manipulation quantity of a brake manipulating means, the information system comprising:

object detecting means for detecting an object ahead of the host vehicle;

contact-possibility determining means for determining a contact possibility of the host vehicle with an object ahead of the host vehicle on the basis of information from the object detecting means;

first correcting means for correcting a generated quantity of the driving force with respect to the accelerator manipulation quantity, according to the contact possibility; and second correcting means for correcting a generated quantity of the braking force with respect to the manipulation quantity of the brake manipulating means, according to the contact possibility.

25. A vehicle comprising:

a vehicle body; and a controller, supported by the vehicle body, and containing a simulation of a virtual member at a front end of the vehicle body, the virtual member functioning as a running resistance of the vehicle when a distance between an object ahead of the vehicle and the vehicle is smaller than a threshold distance.

26. The vehicle as claimed in claim 25, wherein the running resistance is generated by a drive system.

27. The vehicle as claimed in claim 25, wherein the running resistance is generated by at least one of a drive system and a brake system.

28. The vehicle as claimed in claim 25, wherein the running resistance is generated by correcting at least one of a driving-force relationship between a driver demand driving force and an accelerator manipulation quantity and a braking-force relationship between a driver demand braking force and a brake manipulation quantity.

29. The vehicle as claimed in claim 25, wherein the running resistance is varied according to the distance between the object and the vehicle.

30. The vehicle as claimed in claim 25, wherein the virtual member comprises a virtual elastic member.

31. A control system of a host vehicle, comprising:

an accelerator manipulation detecting device that detects an accelerator manipulation quantity of an accelerator according to which a driver demand driving force is generated by an internal combustion engine;

a brake manipulation detecting device that detects a brake manipulation quantity of a brake manipulation device according to which a driver demand braking force is generated by a brake system;

an object detecting unit that detects an object ahead of the host vehicle; and a controller connected to the accelerator manipulation detecting device and the object detecting unit, the controller being configured, to set a virtual elastic member between the object and the host vehicle, the virtual elastic member applying a virtual force which is varied according to the distance between the object and the host vehicle, and to generate the virtual force by correcting a driving-force relationship between the driver demand driving force and the accelerator manipulation quantity according to a contact possibility.

32. The control system as claimed in claim 31, wherein the controller is connected to the brake manipulation detecting device and is further configured to generate the virtual force by correcting a braking-force relationship between the driver demand braking force and the brake manipulation quantity according to the contact possibility.

33. The control system as claimed in claim 31, wherein the controller is further configured to estimate a near-future host vehicle course on the basis of a host vehicle speed and a steering angle.

34. The control system as claimed in claim 33, wherein the controller is further configured to determine the contact possibility when the host vehicle travels the estimated near-future host vehicle course.

35. A controller for a host vehicle which has an object detecting unit that detects an object ahead of the host vehicle, the controller comprising:

a processor containing a simulation of a virtual member in front of the host vehicle which provides feedback to a driver of the host vehicle based on a relationship between the host vehicle and an object ahead of the host vehicle.

36. A controller as claimed in claim 35, wherein an extent of the virtual member in front of the host vehicle changes based on a speed of the host vehicle.

37. A controller as claimed in claim 36, wherein an extent of the virtual member in front of the host vehicle changes based on a product of a speed of the host vehicle and a threshold.

38. A controller as claimed in claim 35, wherein the virtual member comprises a virtual spring.

39. A controller as claimed in claim 35, wherein the controller outputs a signal to adjust a brake system of the host vehicle based on said simulation.

* * * * *